US006193840B1

(12) United States Patent
Elijoki et al.

(10) Patent No.: US 6,193,840 B1
(45) Date of Patent: Feb. 27, 2001

(54) METHOD FOR PRODUCING SURFACE-TREATED PAPER

(75) Inventors: Seppo Elijoki; Heikki Ilvespaa; Antti Kuhasalo, all of Jyvaskyla; Reima Kerttula, Muurame, all of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/383,811

(22) Filed: Aug. 26, 1999

Related U.S. Application Data

(60) Division of application No. 09/040,097, filed on Mar. 17, 1998, now Pat. No. 6,126,787, which is a continuation-in-part of application No. 08/705,059, filed on Aug. 29, 1996, now Pat. No. 5,756,156, which is a continuation of application No. 08/467,780, filed on Jun. 6, 1995, now abandoned.

(30) Foreign Application Priority Data

Feb. 1, 1995 (FI) ..... 950434

(51) Int. Cl.[7] ..... D21F 11/00
(52) U.S. Cl. ..... 162/136; 162/204
(58) Field of Search ..... 162/135, 136, 162/204

(56) References Cited

U.S. PATENT DOCUMENTS

| | | | |
|---|---|---|---|
| 2,281,496 | 4/1942 | Hanson | 34/18 |
| 2,320,883 | 6/1943 | Parkinson | 34/1 8 |

(List continued on next page.)

FOREIGN PATENT DOCUMENTS

| | | |
|---|---|---|
| 3741128 | 6/1988 | (DE) . |
| 9414963 | 12/1994 | (DE) . |
| 0427887 | 5/1991 | (EP) . |
| 0626478 | 11/1994 | (EP) . |
| 80103 | 6/1987 | (FI) . |
| 83441 | 3/1991 | (FI) . |
| 934367 | 10/1993 | (FI) . |
| 935339 | 11/1993 | (FI) . |
| 935340 | 11/1993 | (FI) . |
| 8806204 | 8/1988 | (WO) . |
| 8806205 | 8/1988 | (WO) . |

OTHER PUBLICATIONS

"The Valmet Sym–Run Concept", Paper Asia, May/Jun. 1989, pp. 38–42.
W. Haessner, "Trocknungstechnik und deren Entwicklung", Das Papier 44, 10A, 1990, pp. 155–163.
Jouko Yli–Kauppila, "Dryer Section for High Speed Paper Machines", Proceedings of the Helsinki Symposium of Alternate Methods of Pulp and Paper Drying, Jun. 4–7, 1991.

(List continued on next page.)

*Primary Examiner*—Christopher A. Fiorilla
(74) *Attorney, Agent, or Firm*—Steinberg & Raskin, P.C.

(57) ABSTRACT

A method for producing surface-treated paper, in particular of fine paper, and a dry end of a paper machine that makes use of the method. A paper web that has been dewatered by pressing is dried in the forward dryer section, in which drying energy is applied to the paper web over the entire length of the forward dryer section asymmetrically in the z-direction from the side of the bottom face of the web. This step is carried out by a number of successive groups with single-wire draw that are open downward. In this manner, shrinkage of the web both in the machine direction and in the cross direction is reduced or at least partially prevented, which shrinkage tends to take place when the dry solids content becomes higher. Paper broke is removed from underneath the drying groups that are open downward substantially by the force of gravity onto the broke conveyor placed underneath. The paper web which has a tendency of curling because of the asymmetric forward-drying is passed to the finishing section where it is finished while it is moistened and/or worked plastically so that the tendencies of curling that arose in the web in the forward drying stage are substantially reduced.

12 Claims, 17 Drawing Sheets

U.S. PATENT DOCUMENTS

| | | | |
|---|---|---|---|
| 2,344,686 | 3/1944 | Fanselow | 34/18 |
| 3,016,622 | 1/1962 | Gade et al. | 34/48 |
| 3,260,642 | 7/1966 | Canter, Jr. | 162/252 |
| 3,370,359 | 2/1968 | Beachler | 34/18 |
| 3,490,689 | 1/1970 | Hart et al. | 364/471 |
| 3,610,899 | 10/1971 | Dahlin | 364/477 |
| 3,658,642 | 4/1972 | Keyes, IV et al. | 162/197 |
| 3,753,298 | 8/1973 | Ely | 34/116 |
| 3,767,900 | 10/1973 | Chao et al. | 162/DIG. 11 |
| 3,815,254 | 6/1974 | Mills | 34/31 |
| 3,868,780 | 3/1975 | Soininen et al. | 34/116 |
| 3,886,036 | 5/1975 | Dahlin | 162/198 |
| 4,183,148 | 1/1980 | Koski et al. | 34/23 |
| 4,202,113 | 5/1980 | Kankaanpaa | 34/23 |
| 4,253,245 | 3/1981 | Perrault | 34/48 |
| 4,314,878 | 2/1982 | Lee | 162/198 |
| 4,441,263 | 4/1984 | Vedenpaa | 34/115 |
| 4,502,231 | 3/1985 | Fissman et al. | 34/114 |
| 4,516,330 | 5/1985 | Eskelinen et al. | 34/23 |
| 4,602,439 | 7/1986 | Eskelinen et al. | 34/23 |
| 4,625,430 | 12/1986 | Aula et al. | 34/13 |
| 4,701,857 | 10/1987 | Robinson | 364/477 |
| 4,818,342 | 4/1989 | Wagle et al. | 162/207 |
| 4,905,380 | 3/1990 | Eskelinen et al. | 34/23 |
| 4,972,608 | 11/1990 | Ilvespaa | 34/115 |
| 4,982,513 | 1/1991 | Loser et al. | 34/116 |
| 5,022,163 | 6/1991 | Ilvespaa et al. | 34/23 |
| 5,065,529 | 11/1991 | Skaugen et al. | 34/117 |
| 5,146,696 | 9/1992 | Mayer et al. | 34/117 |
| 5,177,880 | 1/1993 | Preisetanz et al. | 34/117 |
| 5,269,074 | 12/1993 | Sims et al. | 34/117 |
| 5,377,428 | 1/1995 | Clark | 34/446 |
| 5,416,980 | 5/1995 | Ilvespaa | 34/117 |
| 5,469,636 | 11/1995 | Plomer | 162/359.1 |
| 5,470,436 | 11/1995 | Wagle et al. | 162/207 |
| 5,690,999 | 11/1997 | Rantanen | 427/356 X |

OTHER PUBLICATIONS

Sam Palazzolo, "No–draw Drying", Tappi Journal, Sep. 1990.

W. Leitenberger, "Die CONTIRUN–Trockenpartie fur schnellen, sicheren Bahnlauf", Das Papier, Heft 6, 1992.

Ville Korhonen and Antti Kuhasalo, "Ropeless Tail Threading From Press to Reel", World Pulp & Paper Technologie, 1993, pp. 141–144.

H. Lepisto and P. Eskelinen, "Verbesserung der Lauffähigkeit schneller Papiermaschinen mit Hilfe neuer Ventilationseinrichtungen", Das Papier 39, Hecht 10A, 1985, pp. V198–V201.

K. Lindberg, K. Juppi and P. Eskelinen, "High Speed Dryer Section Developments for Sheet Stability", 78th Annual Meeting, Technical Section, CCPA 1992.

Dykes, "Current Techniques for Control of Water Removal at the Presses and Dryers", Pulp & Paper Magazine of Canada, pp. 101–108, vol. 72, No. 1, Jan. 1971.

Meisel, Robert M., "Analog Computer Simulation of Paper Drying", Tappi, vol. 60, No. 1, Jan., 1977,pp. 160–162.

Roberts, Richard W., et al., "Some Plain Talk on Digital Computers", Pulp & Paper, Aug. 12, 1968, pp. 32–37.

Holm, Robert A., et al. "Review of Process Control", Tappi, vol. 53, No. 9, Sep. 1970, pp. 1638–1649.

Hartley, F.T. et al., "The Dynamic Identification of the Drying Process in a Paper Mill", Computers in Engineering, Perth, Australia, Sep., 1976, pp. 168–172. (Class 364–Subclass 471).

Petijean, A.L., "Non–Destructive Measuring of Drying Profile in Machine Direction", Paper Trade Journal, Jul., 1959 pp. 32–34 (Class 162–Subclass Dig. 11).

"MBS Sizepress–Higher Operating Efficiency and Speed With Less Drying Energy", Beloit Corporation, pp. 1, 5, 6, 1980's.

Puusta Paperiin M–504 (From Wood To Paper M–504), Employer's Association Of The Finnish Wood–Working Industry, Index, pp. 69 and 76 (With English–Language Translation), 1980.

Japanese Laid–Open Publication No. 5–222691, Mitsubishi Heavy Industries, Ltd., pp. 4–6 (Drawings) and English–Language Translation, Patent Abstracts Of Japan, vol. 17, No. 225, (C–1055), May 10, 1993, & JP–A–04 361 395.

$W_{OUT}$
$T_8$
$R_8$
$R_7$
$T_6$
$D_1$
$R_2$
$T_1$
$R_1$
$W_{in}$
WS
WS
100
k1
k2

METHOD FOR PRODUCING SURFACE-TREATED PAPER

CROSS REFERENCE TO RELATED APPLICATIONS

This application is a divisional of U.S. patent application Ser. No. 09/040,097 filed on Mar. 17, 1988, now U.S. Pat. No. 6,126,787, which is a continuation-in-part of U.S. patent application Ser. No. 08/705,059 filed Aug. 29, 1996 now U.S. Pat. No. 5,756,156 which in turn is a continuation of U.S. patent application Ser. No. 08/467,780 filed Jun. 6, 1995, now abandoned.

FIELD OF THE INVENTION

The present invention relates to a method for producing surface-treated paper, in particular fine paper.

Further, the present invention relates to a dry end of a paper machine intended for the production of surface-treated paper which has a forward dryer section, also referred to as a "predryer section" or a "main dryer section", and a subsequently arranged on-line or off-line finishing section.

BACKGROUND OF THE INVENTION

In the prior art, in multi-cylinder dryers of paper machines, twin-wire draw and/or single-wire draw is/are employed. Drying groups applying a twin-wire draw include two wires which press the web, one from above and the other one from below, against the heated cylinder faces of the drying cylinders. Between the rows of drying cylinders, which are usually horizontal rows, the web has free and unsupported draws. The free draws are susceptible to fluttering which may cause web breaks, in particular since the web is still relatively moist and, therefore, has a relatively low strength. For this reason, in recent years, increasing use has been made of a single-wire draw in which each group of drying cylinders has only one drying wire. The web runs on support of the single drying wire through the entire group so that the drying wire presses the web on the drying cylinders against the heated cylinder faces thereof, and whereas, on the reversing cylinders or rolls arranged between the drying cylinders, the web remains at the side of the outside curve. Thus, in a single-wire draw, the drying cylinders are placed outside the drying wire loop and the reversing cylinders or rolls are situated inside the drying wire loop.

In prior art normal groups having a single-wire draw, the heated drying cylinders are typically arranged in an upper row and the reversing cylinders are therefore arranged in a lower row, below the upper row. The upper row and lower row are generally horizontal and parallel to one another. The current assignee's Finnish Patent No. 54,627 (corresponding to the current assignee's U.S. Pat. No. 4,202,113, the specification of which is hereby incorporated by reference herein) describes an arrangement wherein normal groups having a single-wire draw and so-called inverted groups having a single-wire draw are arranged one after the other. In typical inverted groups, e.g., of the type shown generally in U.S. Pat. No. 4,202,113, the heated drying cylinders are arranged in the lower row and the reversing suction cylinders or rolls are arranged in the upper row. This arrangement utilizing normal and inverted groups enables a principle objective to be achieved, i.e., to dry the web symmetrically from both of its sides.

With respect to additional prior art, reference is made to published International Patent Applications WO 88/06204 and WO 88/06205 (assigned to Beloit Corp.) which describe dryer sections.

Accordingly, in the following description, the terms "normal (drying) group" and "inverted (drying) group" are used to denote the cylinder groups having a single-wire draw as described above, as such is accepted terminology to those skilled in the art. The expression "single-wire draw" is equivalent to the terms "single felting" and "single tier" which are interchangeably used in the art. Similarly, the expression "twin-wire draw" is synonymous with the expression "double felting" as used in the art. Also, in the following description, the term "wire" when used to denote a wire in the dryer section or finishing section encompasses other types of dryer section clothings such as fabrics, which are more common today than wires, and felts.

In dryer sections that comprise inverted and normal drying groups, various problems have occurred. The present invention is directed toward a resolution of these problems. For example, problems have been encountered in the runnability of the dryer section and in the threading of the web, problems arising from differences in the speeds of different wires, problems in the removal of broke especially in inverted groups, as well as problems related to the control of transverse shrinkage of the web. These problems tend to become worse as the running speed of the paper machine becomes higher. As to the problems of control of the transverse shrinkage of the web, the use of a single tier dryer section in general provides better control than a dryer section applying double felting.

With respect to prior art involved in and related to the present invention, reference is made to the following patent publications and articles published in journals:

- W. Haessner, "Trocknungstechnik und deren Entwicklung"; Das Papier 44, 10A, 1990;
- "The Valmet Sym-Run Concept", Paper Asia, May/Jun 1992;
- J. Yli-Kauppila, "Dryer Section for High Speed Paper Machines", Proceedings of the Helsinki Symposium of Alternate Methods of Pulp and Paper Drying, Helsinki Jun. 4–7, 1991;
- Sam Palazzolo, "No-draw drying", Tappi Journal, September 1990;
- W. Leitenberger, "Die Contirun-Trockenpartie fur schnellen, sicheren Bahnlauf", Das Papier, Heft 6, 1992;
- U.S. Pat. Nos. 3,753,298, 3,868,780, 4,602,439, 4,972,608, 4,982,513, 5,022,163, 5,065,529, 5,146,696, and 5,177,880;
- V. Korhonen and A. Kuhasalo, "Ropeless tail threading from press to reel", World Pulp & Paper Technology 1993;
- H. Lepisto und P. Eskelinen, "Verbesserung der Lauffahighkeit schneller Papiermaschinen mit Hilfe neuer Ventilationseinrichtungen", Das Papier 1985, Heft 10A;
- Lindberg, Juppi, Eskelinen, "High Speed Dryer Section Developments for Sheet Stability", 78th Annual Meeting, Technical Section CPPA, 1992.

With respect to the prior art closely related to the invention, reference is further made to the current assignee's Finnish Patent No. 91,900 (corresponding to U.S. patent application Ser. No. 07/808,161, now U.S. Pat. No. 5,416,980, the specification of which is hereby incorporated by reference herein), in which a method is described for drying a web in the dryer section of a paper machine, in particular for reducing the tendency of curling of the paper web. In the method described in FI '900, the paper web is dried on drying cylinders, against whose heated faces the paper web is pressed by means of a drying wire. In the dryer section, groups of drying cylinders are used, in which twin-wire draw and/or single-wire draw is/are applied. In this method, among other things, it has been considered inventive that in the dryer section, hot water vapor is fed substantially onto the entire width of the paper web. By means of this vapor, tensions that have been formed or that tend to be formed in the fiber mesh in the paper web are relaxed by means of heat and moisture in the area of their formation or substantially immediately thereafter.

In the prior art, a dryer section is known which is composed exclusively of the above drying groups with a single-wire draw. In these groups, between the contact-drying cylinders placed in the upper rows in the groups, normal small diameter suction rolls that are provided with inside (internal) suction boxes have been used. One particular prior art dryer section of interest is a dryer section supplied by, e.g., J. M. Voith GmbH, and situated at PM 1, Stora Feldmuehle, Reisholz, Duesseldorf, Germany which initially contained only single-tiered groups in the predryer section but later was modified to provide a double felted group as the last group in the predryer section.

A drawback of these small diameter suction rolls is the high requirement of negative pressure and suction energy because, owing to the small diameter of these rolls, high centrifugal forces arise on these rolls which tend to separate the web from the drying wire. By means of the curve sectors of small radius, the suction rolls also produce a rather large relative difference in speed between the drying wire and the web, which is in many respects unfavorable. Further drawbacks include the wear of the seals at the suction box inside the suction rolls and the repeated requirement of servicing of these seals as well as the high noise level. In this prior art paper machine, the overall concept in accordance with the present invention has not been taken into use, which concept also includes the paper finishing stages, such as surface-sizing, coating and/or calendaring.

With regard to additional prior art related to the present invention, reference is made to the current assignee's Finnish Patent No. 83,441, Finnish Patent No. 91,899 (corresponding to the current assignee's U.S. patent application Ser. No. 08/230,059, the specification of which is hereby incorporated by reference herein), to Finnish Patent Application Nos. 934367 and 935340 (corresponding to the current assignee's U.S. patent application Ser. Nos. 08/213,148 and 08/229,471, respectively, the specifications of which are hereby incorporated by reference herein), to EP Patent No. 0 427 887 and U.S. Pat. No. 5,269,074 assigned to Beloit Corporation. In the '074 patent, a dryer section is described whose initial part consists of a number of successive normal groups with single-wire draw and in whose final end there is one group with twin-wire draw in which the web has open draws between the rows of cylinders placed one above the other.

In the following, a condensed discussion will be made of the problems and requirements of further development that have been noticed in the prior art dryer sections, which have become known, e.g., from the above-mentioned patents and journal articles. As background, it should be ascertained that the highest web speeds in paper machines are, at present, already of an order of about 25 meters per second, but before long even the speed range of 25–40 m/s will be applied. Then, the bottle-neck of the runnability of a paper machine will increasingly consist of the dryer section, thus provoking an intensive effort to develop dryer sections capable of running at ever more increasing web running speeds.

In the inverted drying groups mentioned above, one particular problem is the removal of broke in the event of web breaks, for inverted groups are not self-cleaning by the effect of gravity. Thus, it is an object of the present invention to provide a paper machine, in particular for the manufacture of fine paper, in which inverted groups are not needed at all but which, nevertheless, meets the other requirements that are imposed.

The above problems and some other problems are emphasized further if, in single-wire groups, the prior art small-diameter suction rolls proper are used which are provided with inside suction boxes. In order to eliminate this problem, in some machines, it has been even necessary to open some group gaps and to lower the vacuum level in the suction rolls.

From operational experience, it is known that, if the paper is dried one-sidedly, the consequence is a tendency of curling of the sheet which is not a desired trait.

When paper is dried by means of normal groups with single-wire draw from the side of its bottom face and if such asymmetric drying is extended over the entire length of the forward dryer section, the drying takes place so that first the side of the bottom face of the paper web is dried, and when the drying makes progress, the drying effect is also spread to the side of the top face of the paper web. Thus, the dried paper is usually curled so that it becomes concave when seen from above.

As known in the prior art, the tendency of curling of paper is already affected in connection with the web formation, in particular in the stage of sheet formation (see for example, the current assignee's Sym-Former™ concept) by means of the discharge jet and by selection of the difference in speed of the wire as well as by means of other running parameters. As known from the prior art, for example in the case of copy paper, by means of unequalsidedness of drying in the finishing-dryer section, a suitable initial curling is regulated for the sheet in order that the curling of the paper after one-sided and two-sided copying could be optimized. In the case of copying paper, the reactivity of curling, i.e., the extent of curling produced per unit of change in moisture content, is affected to a greater extent by means of the z-directional structure, i.e., the structure in the direction of the thickness of the paper, which is produced in connection with the web formation in the wet end.

The most recent prior art related to the present invention in high-speed paper machines, in particular in fine-paper machines, has been based on dryer sections in which there is single-wire draw over the major part of the length of the dryer section and, with a view toward controlling the tendency of curling of paper, in practice, also an inverted group has always been employed in order that the drying could be made sufficiently symmetric in the z-direction. As noted above, an inverted group results in evident drawbacks in respect of the overall efficiency of the machine, as well as the runnability of the machine, and in respect of the profitability of the paper machine investment. Thus, in view of the optimization of the efficiency of a paper machine, a fully supported dryer section based on normal groups with single-wire draw, without inverted groups or groups with twin-wire draw, would be a particularly justified and advantageous embodiment. The professionals in this field have, however, not been courageous enough to develop and introduce such an embodiment because it has been considered that it would be uncontrollable and unfavorable in view of the tendency of curling of the paper.

Reference is also made to Finnish Patent Application No. 940749, corresponding to U.S. patent application Ser. No.

08/389,952, the specification of which is hereby incorporated by reference herein. This application describes a dryer section which does not include any inverted dryer groups.

OBJECTS AND SUMMARY OF THE INVENTION

Accordingly, it is an object of the present invention to approach the problems discussed above from a new point of view and to suggest new and novel embodiments contrary to conventional modes of thinking for these problems.

It is another object of the present invention to provide a dry end of a paper machine with finishing equipment having a high efficiency while producing good paper quality, i.e., diminished curling of the web, due in part to the integrated unity of the dry end of the paper machine.

It is a further object of the invention to provide a dry end of a paper machine with finishing equipment in which so-called ropeless tail threading can be applied favorably over the entire length of the dryer section in the machine direction, which contributes to making the constructions simpler and machine standstill times shorter.

In view of achieving the objects stated above and others, in the method in accordance with the invention for producing surface-treated paper, in particular fine paper, comprises the following steps which are preferably carried out in the listed sequence:

a1) a paper web which has been dewatered to a first dry solids content $k_1$ from about 35% to about 60% by pressing is dried in a forward dryer section to a second dry solids content $k_2$ from about 90% to about 99%;

a2) the forward-drying in step a1) is carried out by applying drying energy to the paper web to be dried over the entire length of the forward dryer section asymmetrically in the z-direction from the side of a bottom face of the web;

a3) the step a1) is carried out by means of a number of successive groups with single-wire draw that are open downward on support of a drying wire such that shrinkage of the web both in the machine direction and in the cross direction is reduced or at least partially prevented, which shrinkage tends to take place when the dry solids content becomes higher;

b1) the paper web, which has a tendency of curling because of the asymmetric forward-drying that has taken place in steps a1)–a3), is passed to a finishing section; and b2) the paper web is finished in the finishing section by surface treatment operations, which include surface coating/sizing which are effective to moisten the web, and/or by calendaring, i.e., supercalendering and soft calendaring, which both plastically deform or "work" the web, so that the tendency of curling that arose in the web in the forward dryer section is substantially reduced. The moistening process and the plastic deformation process, if both are utilized, are typically performed one after the other in the running direction of the web.

In one embodiment, in connection with a web break taking place in the stage a3, the removal of paper broke is carried out from underneath the drying groups that are open downward, substantially by the force of gravity onto a broke conveyor placed underneath.

The forward drying section mentioned in stage a1) is also commonly referred to as a "predryer section" or a "main dryer section". Also, in the event that the finishing section is a soft calendar, no additional dryer section is required.

In one particular embodiment, the web is passed from the forward dryer section to a finishing section, through at least one surface-sizer or coating device arranged in the finishing section from which size or a coating agent are applied onto one or both sides of the web to treat the surface of the web, the web is then dried in an after-dryer section, and the curling tendency of the web that arose in the forward dryer section is reduced by passing the web through a calendering unit including at least one calendering nip, each calendering nip being defined by a pair of rolls, and asymmetrically calendering the web in the calendering unit to thereby affect the sides of the web to different degrees. The web may be asymmetrically calendered, i.e., subjected to a different working effect on different sides, by applying an asymmetric loading of the rolls in the calendering nip, providing the rolls with a different temperature and/or providing the rolls with a different hardness. Thus, two or all three of these, or other, different ways for asymmetrically calendering the web may be applied in combination with one another. The mechanical loading of the rolls in each calendering nip might be the same on both sides of the web. The calendering unit including at least one calendering nip may be arranged between the forward dryer section and the finishing section and another possibly similar calendering unit including at least one calendering nip may be arranged after the after-dryer section and before a machine reel-up. To further reduce the curling tendency of the web, one or both sides of the web may be moistened at a location before each calendering nip and optionally, different quantities of moistening agent are applied to both sides of the web before the calendering nip to thereby provide asymmetric moistening of the web.

The dry end of a paper machine in accordance with the invention with its finishing equipment comprises a forward dryer section including groups with single-wire draw of a multi-cylinder dryer arranged over its entire length between the press section of the paper machine and a first finishing unit, which groups are open downward and include steam-heated drying cylinders against which the web to be dried is pressed into direct contact by a loop of a drying wire that runs above each of the groups with single-wire draw. The groups with single-wire draw include a number of reversing suction cylinders or rolls arranged inside the drying wire loop. By means of the reversing suction cylinders or rolls, the paper web is kept in contact with the drying wire by the effect of a difference in pressure and/or by means of the tightening pressure of the web when the paper web is at the side of the outside curve. The group gaps between the groups with single-wire draw are closed, or there is only a small open draw in the group gap. After the forward dryer section or as an off-line unit, a finishing section is arranged for surface-treating the dried web while it is worked plastically and/or moistened so that the tendency of curling that arose in the web in the forward dryer section are substantially eliminated.

In one particular embodiment, the finishing section includes means for surface-treating the web selected from a group consisting of a surface-sizer including application means for applying size onto one or both sides of the web and a coating device including application means for applying a coating agent onto one or both sides of the web and drying means arranged after the web surface-treating means in a running direction of the web for drying the web. The dry end also includes means for reducing the curling tendency of the web that arises in the forward dryer section, namely, at least one calendering nip, each defined by a pair of rolls between which the web is passed and which pair of rolls are structured and arranged to asymmetrically calender the web to thereby affect the sides of the web to different degrees.

In the concept in accordance with the invention, in which the forward-drying takes place by means of a forward dryer section comprising groups with single-wire draw without inverted groups, after the forward-drying the tendency of curling of the paper becomes obvious. However, since in the invention, a surface-sizing unit is used or the paper is coated, the paper faces are wetted, whereby expanding and, at the same time, relaxing of the paper sheet take place. When the finishing-dryer is a normal dryer with twin-wire draw in which the temperatures of the upper and lower cylinders can be regulated independently from one another, the curling can be regulated by means of the drying. Also, the curling can be affected by regulating the operation of the size press. Then, in fact, a compromise is made, for example, in respect of the symmetric size quantity because the faces are wetted in a controlled way asymmetrically so as to achieve the object of the invention.

When the web is surface-sized in a finishing stage included in the overall concept in accordance with the invention, the paper web is wetted from the sides of both of its faces, in a controlled way asymmetrically if necessary, and this results in relaxation of the tensions that produce a tendency of curling. After this stage, by means of the finishing-drying, the curling can be regulated to a minimal level. Thus, in the present invention, asymmetric moistening of the paper web can be used as an efficient parameter to control the tendency of curling of the web vis-a-vis the asymmetric calendering of the web resulting from the application of different quantities of moisture to the web before the calendering nip.

In accordance with the invention, a dry end of a paper machine with finishing equipment with an improved runnability can be accomplished. It has been possible to achieve this in particular in the manufacture of fine paper so that the problems related to uncontrollability of the tendency of curling of the paper are also substantially eliminated.

According to the basic concept of the invention, the dryer section situated after the press section of the paper machine includes, substantially over its entire length, a number of so-called normal groups with single-wire draw (e.g., the SYM-RUN™ concept), in which the paper web is constantly supported on the drying wire also on the reversing suction cylinders placed in the lower rows in the drying groups, such that transverse shrinkage of the paper web is reduced or at least partially prevented. The group gaps between the groups with single-wire draw are preferably also fully closed so that, in view of the runnability of the machine, a fully supported single-wire draw is achieved.

In a high-speed fine-paper machine in accordance with the invention, the forward dryer section comprises typically about 6–9 normal groups with single-wire draw, in which groups there are a total of about 30–40 steam-heated contact-drying cylinders and a corresponding number of reversing suction cylinders or rolls, preferably the current assignee's VAC™ rolls. In addition to a fully supported forward dryer section with single-wire draw of the sort defined above, the overall concept in accordance with the invention also includes the paper finishing devices belonging to fine-paper machines, in which devices the paper is subjected to finishing in the form of surface-sizing, coating and/or to additional working in the form of calendaring. In this manner, faults of curling produced in the paper by the asymmetric drying in the z-direction taking place in the fully supported dryer section with single-wire draw can be eliminated so that a paper product that meets even high quality requirements, in particular a fine paper whose grammage is in the range of about 60 to about 150 g/m$^2$, can be produced with an improved efficiency. Thus, in the invention it has been realized that a two-sided drying of the web in the forward dryer section, which drying was considered to be indispensable in the prior art, is not necessary in view of the quality of the ultimate product, and not even the most advantageous embodiment in view of the runnability and overall efficiency of the paper machine.

In the coating of paper in accordance with the overall concept of the present invention, re-wetting of the faces also takes place, even if this moistening is not equally thorough as in surface-sizing. However, the faces of paper, which are most important in view of the curling, become moist, and by means of renewed drying it is possible to control the curling. The coating in itself reduces the tendency of curling, because the faces of paper receive an abundance of inert material, whose moisture expansion is substantially lower than that of the fibers. Thus, as a result of the coating, the faces of paper become passive in respect of moisture expansion, and on the other hand, the moisture expansion of both faces becomes substantially equal whereby the tendency of curling is reduced. During finishing of paper, super-calendaring or soft-calendaring produce plastic changes in the paper. When plastic deformation of the sheet takes place during calendaring processes, the tendency of curling is affected and can be controlled by means of asymmetry of calendaring. Another stage of treatment that affects the tendency of curling in connection with calendaring is pre-moistening of paper taking place by means of steam, which can be carried out in the invention unequal-sidedly in respect of the faces. By regulating the unequal-sidedness of the moistening with steam, it is possible to regulate the tendency of curling.

If necessary, the dryer section to be applied in the present invention may be provided with water-vapor treatment as described in the current assignee's Finnish Patent No. 91,900, which treatment is intended for reducing the tendency of curling and in which treatment stresses or strains that have arisen, or tend to arise, in the fiber mesh of the paper web are relaxed by means of heat and moisture in the area of formation of the drying-induced internal stresses or strains or substantially immediately after that area. Further, by means of this water-vapor treatment, it is possible to control the transverse moisture profile of the paper web.

In a fully supported dryer section with single-wire draw in a paper machine in accordance with the invention, it is possible, if necessary, to use various arrangements in themselves known, such as the current assignee's "Uno Run Blow Boxes"™, by whose means the support contact between the drying wire and the paper is promoted at least at the most critical points.

In the following, the invention will be described in detail with reference to some exemplifying embodiments of the invention illustrated schematically in the figures in the accompanying drawings. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
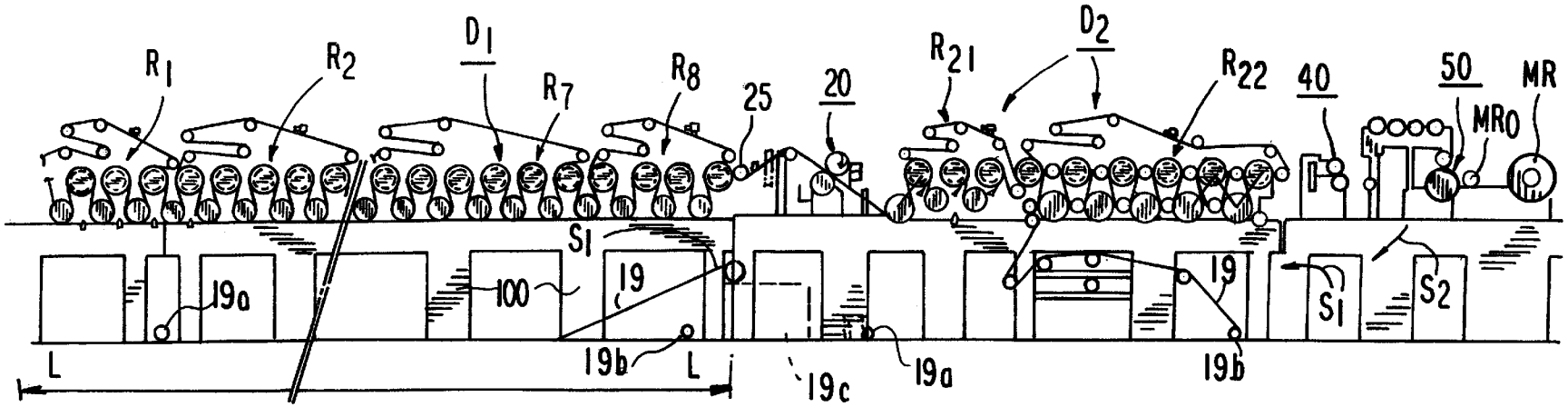
FIG. 1 shows a side view of a paper-machine dry end in accordance with the invention from the beginning of the forward dryer section to the machine reel-up.
Figure 2A:
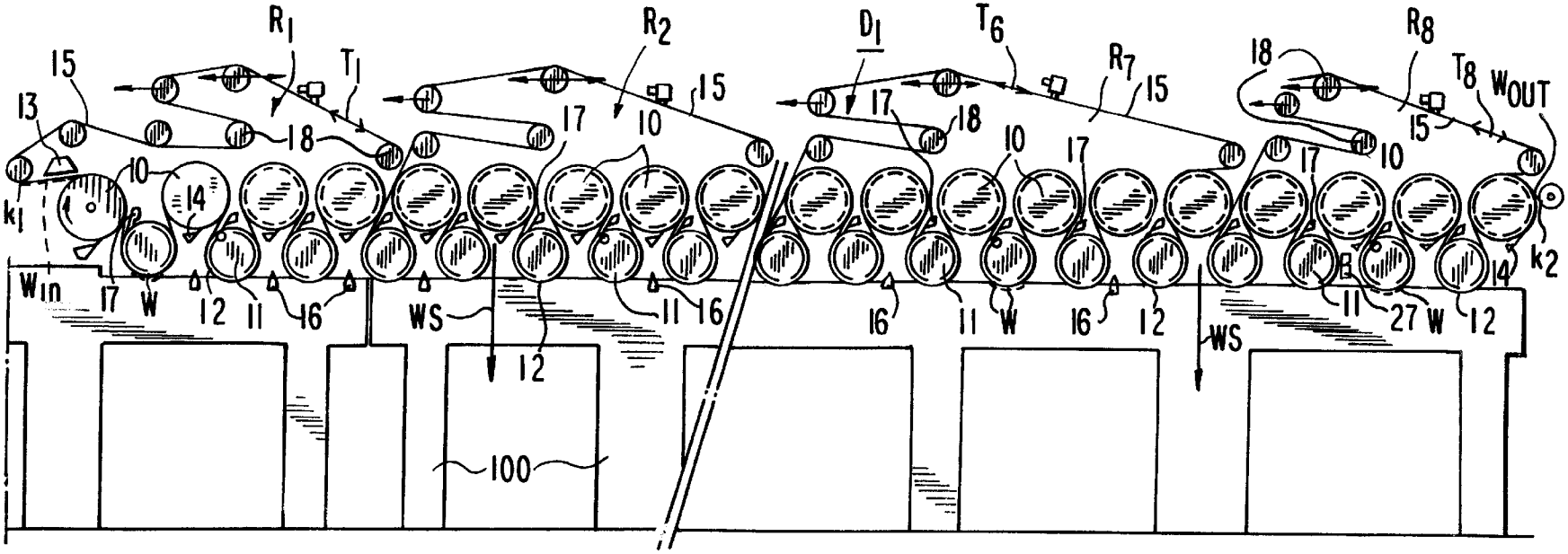
FIG. 2A shows the forward dryer section in the paper-machine dry end as shown in FIG. 1.

Referring to the accompanying drawings wherein like reference characters refer to the same or corresponding elements, in accordance with the embodiments shown in FIGS. 1, 2A, 2B and 11, a paper web $W_{in}$ is brought to a forward dryer section D1 from a press section (not shown) in which the web is dewatered by pressing to a dry solids content $k_1$ of between about 35% and 60% onto a drying wire 15 of a first dryer group $R_1$ with single-wire draw. The web initially adheres to the wire 15 after the press section by the effect of negative pressure in suction boxes 13 (FIG. 2A). The forward dryer section comprises 8 groups $R_1, \ldots, R_8$ with single-wire draw and the web W has closed draws in group gaps defined between each adjacent dryer group.

Figure 11:
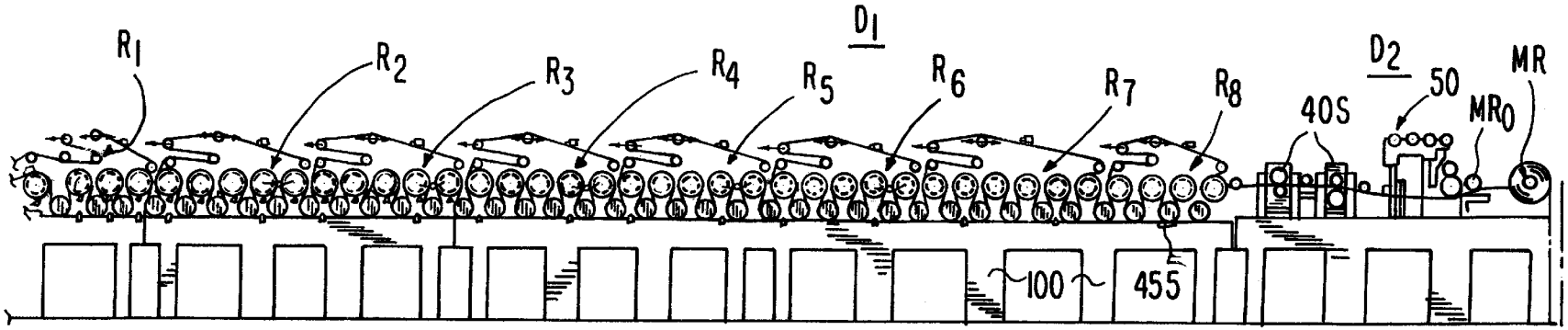
FIG. 11 shows a paper-machine dry end in accordance with the invention in which the forward dryer section is followed by a soft calender before the reel-up.

In the forward dryer section D1 shown in FIGS. 1 and 11, which is included in the overall concept of the invention, there are normal groups $R_{1, \ldots, N}$, N being from 4 to 11, preferably N is 6 to 9. All the single-wire groups $R_1, \ldots, R_N$ are so-called normal groups in which steam-heated smooth-faced drying cylinders 10 are situated in an upper horizontal row and reversing suction cylinders 11 are situated in a lower horizontal row underneath the upper row of drying cylinders 10.

Each normal group $R_1, \ldots, R_N$ has a separate drying wire 15 which is guided by guide rolls 18. Each drying wire 15 presses the web W to be dried on the drying cylinders 10 in the dryer group against their smooth heated faces, and on the reversing cylinders 11, the web W remains at the side of the outside curve on the outer face of the wire 15. On the reversing cylinders 11, the web W is kept reliably on support of the wire 15 against the effects of centrifugal forces by the effect of the negative pressure present in grooved faces 12 of the reversing cylinders 11 or in the perforated mantle of corresponding suction rolls, whereby transverse shrinkage of the web W is also counteracted. The reversing suction cylinders 11 that are used are particularly favorably suction cylinders marketed by the current assignee under the trademark "VAC-ROLL"™, which cylinders do not have inside (internal) suction boxes and with respect to the details of whose constructions reference is made to the current assignee's Finnish Patent No. 83,680 (corresponding to the current assignee's U.S. Pat. Nos. 5,022,163 and 5,172,491, the specifications of which are hereby incorporated by reference herein).

Figure 2B:
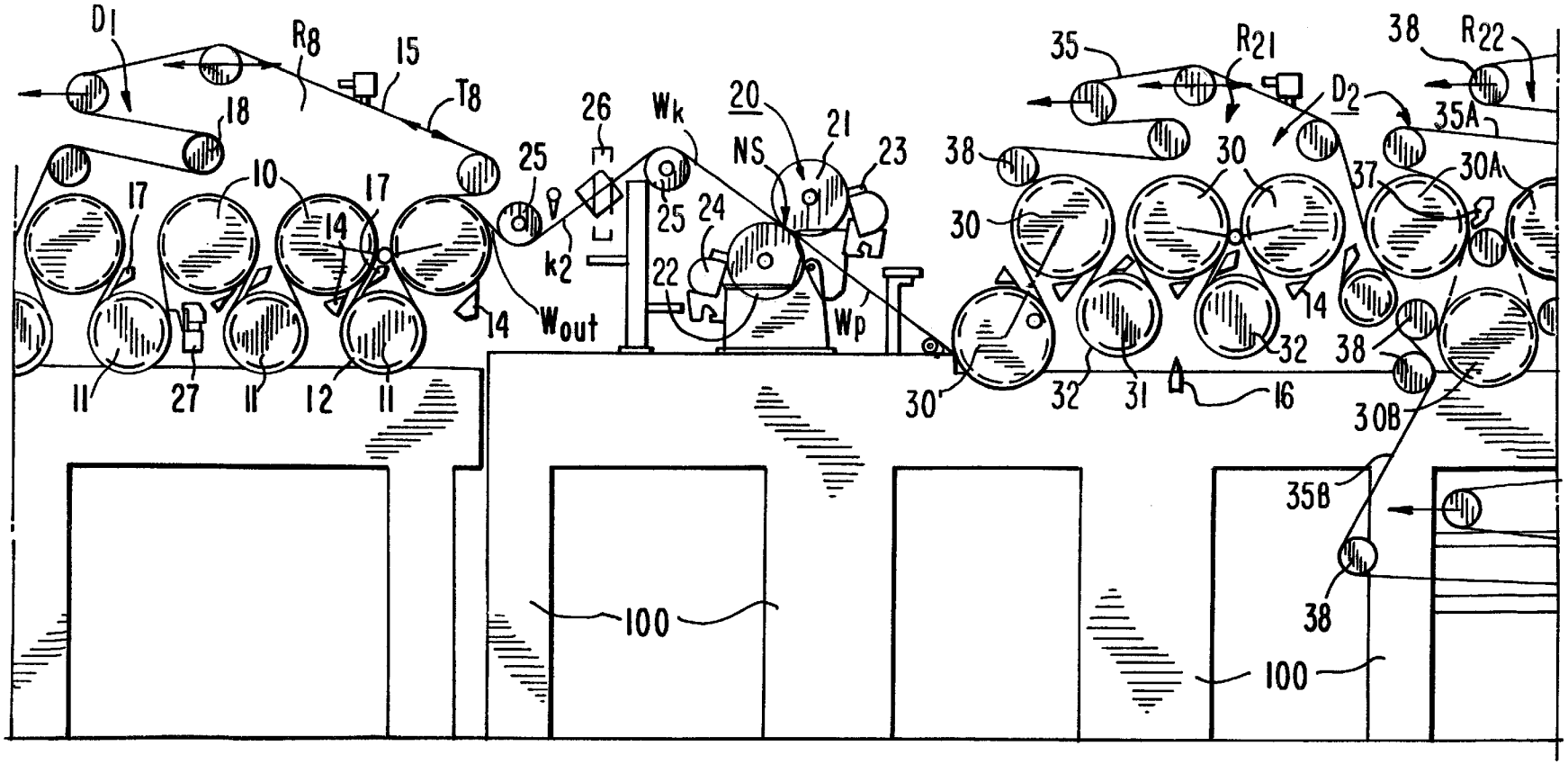
FIG. 2B shows the final end of the forward dryer as shown in FIGS. 1 and 2A, the surface-treatment unit, and the forward end of the finishing dryer.

In a forward dryer section D1 in accordance with a preferred embodiment of the invention, the support contact between the web W and the drying wire 15 is also kept adequate on the straight runs between the drying cylinders 10 and the reversing cylinders 11 by employing blow-suction boxes 17 at least on the runs from the drying cylinders 10 to the reversing cylinders 11 (FIGS. 2A and 2B). The blow-suction boxes 17 prevent the formation of pressures induced by the air that follows the wire 15 in the closing wedge-shaped nip spaces between the wire 15 and the mantle of each of the cylinders 11 as well as by air that follows the surface of the cylinders 11. Blow-suction boxes 17 are understood in the art to denote blow boxes in which the air blowing produces a negative pressure, and the boxes 17 do not communicate with sources of negative pressure. With respect to the details of the constructions of these blow-suction boxes 17, which are marketed by the current assignee under the trade mark "UNO RUN BLOW BOX"™, reference is made to the current assignee's Finnish Patent Nos. 59,637, 65,460 and 80,491 (corresponding to the current assignee's U.S. Pat. Nos. 4,441,263, 4,516,330 and 4,905,380, the specifications of which are hereby incorporated by reference herein). After the introduction of the "UNO RUN BLOW BOX"™, other embodiments of blow boxes were introduced, with respect to which reference is made to U.S. Pat. No. 4,502,231 (assigned to J. M. Voith GmbH), the application of this blow box in the positions of the blow boxes 17 is also included in the scope of the overall concept of the present invention.

As shown in FIGS. 2A and 2B, in the groups $R_1, \ldots, R_N$ with single-wire draw in the forward dryer section D1, blow boxes 16 may also used in the gaps between the reversing cylinders 11, although not every gap is provided with such a blow box 16. By means of boxes 16, the intermediate spaces (gaps between the reversing cylinders) are air-conditioned and evaporation of water from the web W is promoted. The faces of the drying cylinders 10 are kept clean by suitable doctors 14.

In the forward dryer section D1 applied in the invention, it is a further advantage that broke removal by the force of gravity can be applied in the groups $R_1, \ldots, R_N$ with single-wire draw, which extend over the entire length of the dryer section. This results from the fact that the groups $R_1, \ldots, R_N$ with single-wire draw are open toward the bottom so that the paper web WS that becomes broke can be removed without any particular arrangements onto the broke conveyor (not shown) placed in the basement space of the paper machine, and carried on the conveyor further into a pulper or pulpers.

In FIG. 1, the overall horizontal length L of the forward dryer section D1 in the machine direction is about 80 m when eight normal groups $R_{1, \ldots, N}$ are used (N=8). The number N1 of the drying cylinders 10 used in each of the normal groups $R_{1, \ldots, N}$ is in the range of from 3 to 8, preferably from 4 to 7.

With a view toward reducing transverse shrinkage of the web W, it is particularly important that, in the forward dryer section D1, the web W is kept constantly in reliable contact with the drying wires 15. This holding effect is produced on the reversing cylinders 11 by means of the negative pressure present in the grooved mantle 12 or equivalent on the outer face of reversing cylinders 11 and, on the straight draws between the cylinders 10 and the reversing cylinders 11, by means of pressure levels provided by blow-suction boxes 17, and also partly by means of a tension T of the web W in the machine direction, which produces a contact pressure $P_k$=T/R (R=radius of the cylinders 11) between the web W and the wires 15.

As stated above, the reversing cylinders 11 that are used in the forward dryer section D1 are preferably the current assignee's VAC™ rolls, in whose interior preferably a vacuum level of about 1 kPa to about 3 kPa is used. This pressure effect is spread through the perforations in the reversing cylinders 11 into the grooved mantle 12. In this manner, and in combination with the Uno-Run Blow Boxes™ 17, the wedge-shaped nip spaces between the reversing cylinders 11 and the drying wire, i.e., the closing nip, can be evacuated efficiently. Moreover, a positive pressures cannot be induced in these wedge spaces which might attempt to separate the web W from the drying wire while the web W is placed outside. If the reversing cylinders 11 in the forward dryer section D1 are suction rolls provided with inside suction boxes, the suction zone should preferably be extended to an area wider than the turning sector of the drying wire 15 and the web, so that the suction effect and the free air flow can be extended to the wedge spaces for the purposes mentioned above.

When the forward dryer section D1 applied in the invention comprises groups $R_1, \ldots, R_N$ with single-wire draw alone, the dryer section is open toward the bottom. This results in the substantial advantage that, in the event of a web break, the removal of paper broke WS can be carried out from underneath the drying groups $R_1, \ldots, R_N$ open toward the bottom mainly by the force of gravity onto a broke conveyor placed underneath. FIG. 1 shows the conveyor belt 19 of the broke conveyor and its drive rolls 19*a*, 19*b*. On the belt 19 of the broke conveyor, the paper broke WS is passed to a pulper 19*c* placed at one end of the broke conveyor.

In addition to the forward dryer section D1 described above, the overall combination in accordance with the invention and the dry end of the paper machine that makes use of the method include a finishing unit or section D2 arranged after the forward dryer section D1. The finishing unit includes a machine reel-up 50, for example a Pope-type reel-up. The machine reel that is being prepared by means of the reel-up 50 on-line is denoted with the reference MRo, and one complete machine reel with the reference MR.

As shown in FIGS. 1, 2B, 2C, and 2D, after the forward dryer section D1, the paper web Wk, which has been dried to a dry solids content of $k_2$ from about 96% to about 99%, is passed over paper guide rolls 25 and across a measurement beam 26, which measures the property profiles of the paper and is placed between guide rolls 25, to a coating device 20 which constitutes a part of the finishing section D2. Coating device 20 is, for example, a coating device marketed by the current assignee under the name Sym-Sizer™. The coating device 20 includes two opposite applicator rolls 21 and 22, in connection with both of which there is a size feed device 23 and 24 so that the paper web Wk is coated from both sides in a coating nip NS formed between the rolls 21 and 22 to thus constitute a finishing operation conducted in the finishing section D2. Owing to the water-containing coating agent, the web $W_k$ is moistened from both sides in the coating nip. Then, the web, which was dried in the forward dryer section D1 asymmetrically from the side of its bottom face $W_a$ and which has a tendency of curling, is treated to such a condition that its internal strains are primarily relaxed or are at least substantially reduced.

Figure 2C:
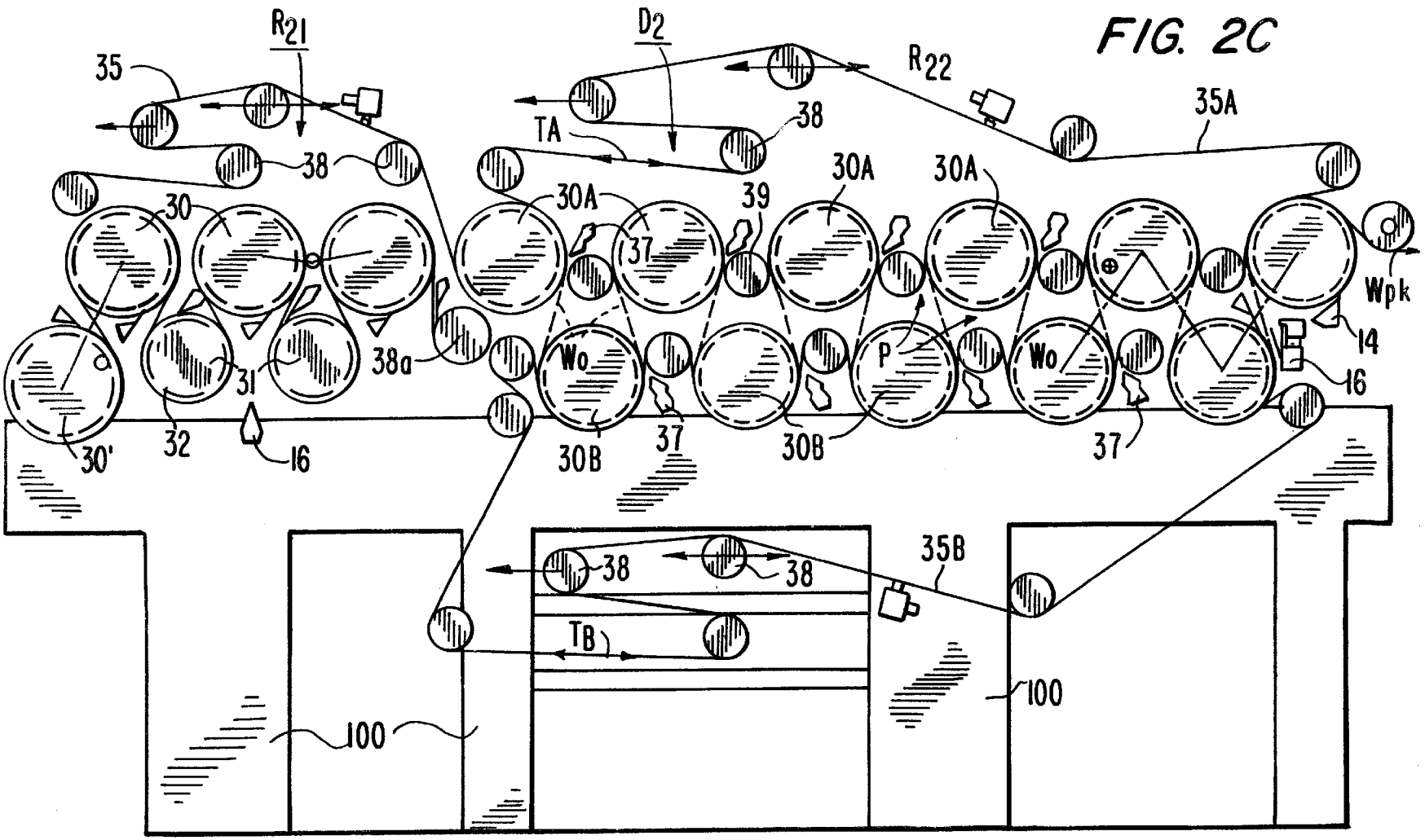
FIG. 2C shows a finishing dryer in a paper machine shown in FIGS. 1, 2A and 2B.

As shown in FIG. 2B, the web $W_p$ that has been moistened and coated from both sides is passed to the finishing section D2. As shown in FIGS. 1 and 2C, an "afterdryer" or finishing-dryer unit of the finishing section comprises two wire groups $R_{21}$ and $R_{22}$. Of these, the first group $R_{21}$, is a group with single-wire draw, and the group $R_{22}$ is a group with twin-wire draw. After the coating device 20, a first lower cylinder 30' is a drying cylinder whose face is coated so that adhering of the web $W_p$ to the face is prevented, such as with the current assignee's "Release Mate"™ coating (FIG. 2C). In the upper row of the group $R_{21}$, there are steam-heated drying cylinders 30, and in the lower row there are reversing suction cylinders 31, for example the current assignee's Vac rolls, which have grooved faces 32 subjected to a vacuum from the interior.

The drying wire 35 of the group $R_{21}$ carries the web $W_p$ as a closed draw to the next twin-wire group $R_{22}$, owing to which, the web moistened in the coating device 20, can be dried symmetrically from both sides without a tendency of curling.

As further shown in FIG. 2C, the group $R_{22}$ with twin-wire draw comprises two horizontal rows of steam-heated drying cylinders 30A and 30B, between which the web has free draws $W_0$. The group $R_{22}$ includes an upper wire 35A which is guided by guide rolls 38 and by guide rolls 39 arranged in gaps between the upper cylinders 30A. Similarly, the group $R_{22}$ includes a lower wire 35B which is guided by the guide rolls 38 and by the guide rolls 39 arranged in gaps between the lower cylinders 30B.

Also, as shown in the embodiment in FIG. 2C, at the vicinity of the wire guide rolls 39, at the inlet side of the web W and of the drying wire 35A and 35B, air-blow boxes 37 are used. Out of the blow boxes 37, which are arranged in gaps between the drying cylinders 30A,30B, controlled air jets having a suitable direction and blow velocity are applied to the vicinity of the runs of the drying wires 35A,35B placed at their proximity and to the vicinity of the free sectors of the wire guide rolls 39. By means of the air jets, the support contact between the drying wires 35A,35B and the web W is promoted, formation of detrimental differences in pressure and fluttering of the web W on the free draws $W_0$ are counteracted. These blowings can also be applied through the drying wires 35A,35B, whereby it is possible to promote the ventilation of the pocket spaces P formed in the gaps between the drying cylinders 30A,30B.

In the twin-wire group $R_{22}$ as shown in FIG. 2C, it is also possible to employ the draw arrangement marketed by the current assignee under the trade mark "TWIN-RUN"™, in which the guide rolls 39 are placed so that the drying wires 35A and 35B accompany the web from one of the drying cylinders 30A and 30B onto the next drying cylinder so that the free draws $W_0$ of the web W can be made shorter, as compared with free draws of full length. With respect to the further details of the "TWIN-RUN"™ concept and of the blow boxes 37, reference is made to the current assignee's Finnish Patent No. 80,103 (corresponding to DE Patent No. 3,818,600).

A regulation parameter that can be utilized in the invention and by whose means the symmetry of the drying of the opposite sides of the web W can be controlled is the tensions $T_A$ and $T_B$ of the drying wires 35A,35B in the group $R_{22}$ shown in FIG. 2C. In a preferred embodiment of the invention, $T_A$ and $T_B$ are selected in a range from about 1.5 to about 8 kN/m, preferably in a range from about 2 to about 5 kN/m. It is also possible to use an arrangement of tension of the drying wires 15 in which, also in a normal group $R_1, \ldots, R_N$. The tension Tn of the wires 15 may be increased constantly as the drying makes progress, in accordance with the principles that are described in the current assignee's Finnish Patent No. 83,441.

Moreover, the wire tensions $T_A$ and $T_B$ of the lower and upper wires 35A and 35B in the single twin-wire group $R_{22}$ or groups can be selected to be different from one another if the symmetry of the drying of the web W and the objectives of the invention require that. An embodiment is particularly advantageous in which the tension $T_B$ of the wire 35B of the lower cylinders 30B is higher than the tension $T_A$ of the upper wire 35A. As such, the symmetry of drying is promoted by in the single twin-wire group $R_{22}$ drying the upper side $W_y$ of the web W to a greater extent. The symmetry of drying can also be promoted by in the twin-wire group $R_{22}$ using different steam pressures and cylinder-face temperatures in the upper cylinders 30A as compared with the lower cylinders 30B. Preferably, in the lower cylinders 30B, a higher steam pressure and cylinder-face temperature are employed than in the upper cylinders 30A, whereby, together with the difference in tension ($T_B > T_A$) between the wires 35A and 35B, the symmetry of the drying of the web W is promoted further by drying the upper face $W_y$ of the web W in the single twin-wire group $R_{22}$ to a greater extent than the lower face Wa, whose drying proportion was, in the normal groups $R_1, \ldots, R_N$ in the forward dryer section D1, owing to the cylinders 10, higher than the drying of the upper face $W_y$. Moreover, the above asymmetry of drying can be controlled by selecting the permeabilities of the upper wire 35A and the lower wire 35B to be different.

The various means, described above with regard to the twin-wire group $R_{22}$, for regulating the symmetry of the drying of the opposite sides $W_a$ and $W_y$ of a surface-sized and/or coated web, which may be calendared if necessary, and, if necessary, for regulating an asymmetry of drying controlled in view of the objectives of the invention, can also be used in the twin-wire groups $R_{61}$ (FIG. 6), $R_{91}$ and $R_{92}$ (FIG. 8), and $R_{101}$ (FIG. 9) which will be described below.

Figure 2D:
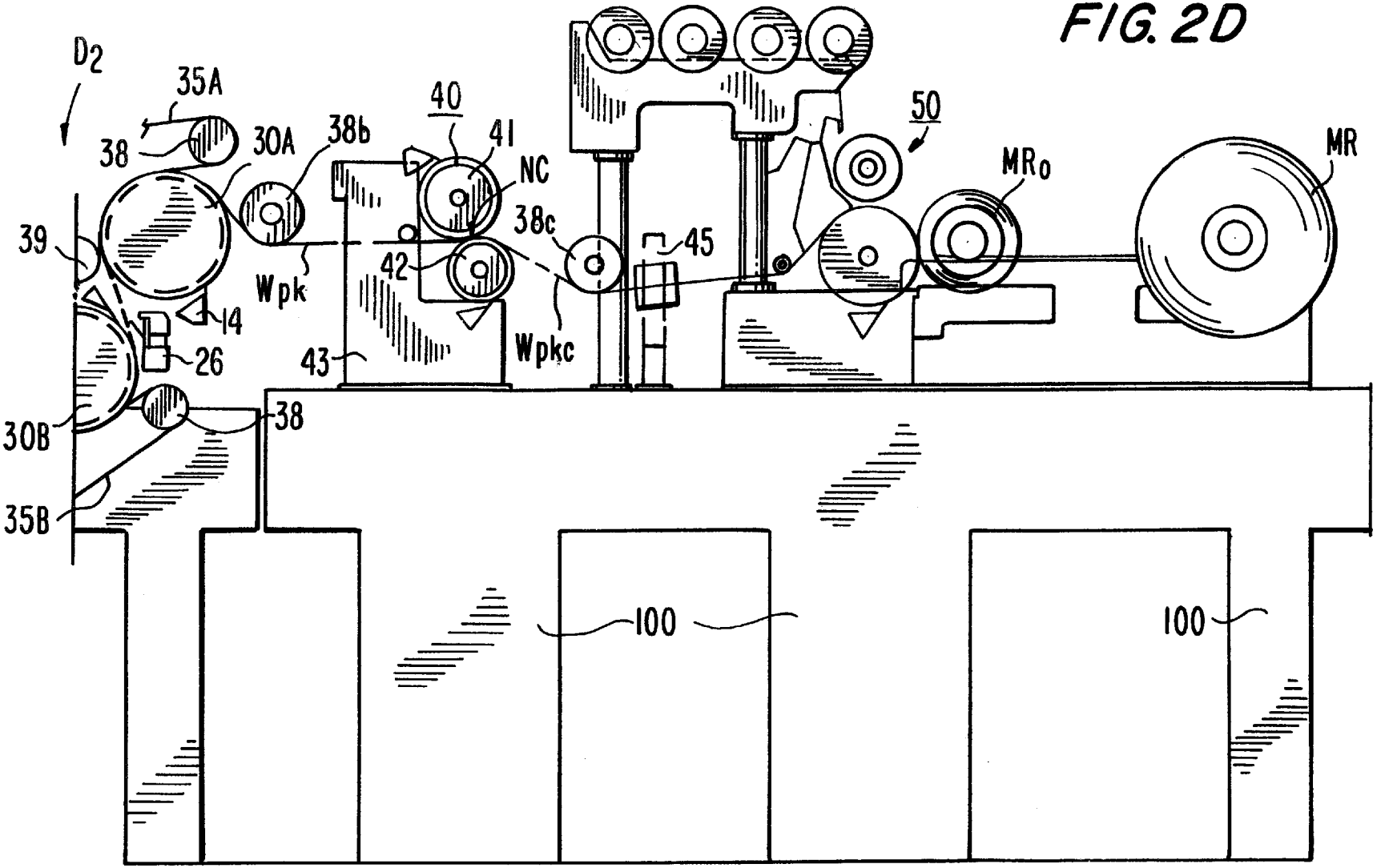
FIG. 2D shows a machine calender and a machine reel-up in a dryer section as shown in FIGS. 1, 2A, 2B and 2C.

The web $W_{pk}$ which has been dried in the finishing section D2 to some extent asymmetrically, is passed to the next finishing unit, which is a calender 40, which may be a soft calender and/or asymmetrically calender the web as described below with reference to FIGS. 11 and 11A. If necessary or desired, as the calender 40, it is also possible to use two or more soft calender units placed one after the other. A calendering nip NC in the calender 40 is formed between calender rolls 41 and 42 supported on a frame 43. The lower roll 42 is an adjustable-crown roll in view of regulation of the nip pressure in the calendaring nip NC. The coated and calendared web $W_{pkc}$ is passed over a paper guide roll 38*c* and across a measurement beam 45 to the machine reel-up 50 which is, for example, a Pope-type reel-up, by whose means a machine reel $MR_o$ is formed out of the web $W_{pkc}$ as shown in FIG. 2D. The complete machine reel is denoted by reference MR. As described above, in the finishing unit D2, the web is dried from the sides of both of its faces $W_a$ and $W_y$ so that the drying is sufficiently symmetric in the z-direction to compensate for any faults of curling that have arisen in the forward dryer section D1 and to prevent formation of any further faults.

In the finishing sections described above, the ratio of the proportions of moistening of the opposite sides $W_a$ and $W_y$ of the web W and/or the ratio of the proportions of drying of the opposite sides $W_a$ and $W_y$ of the web W and/or the relative sequence of these factors is/are regulated so that the tendency of curling that has arisen in the forward dryer section D1 can be eliminated to an extent that is necessary in view of the quality and the purpose of use of the paper that is manufactured. The finishing sections D2 described above and those that will be described in the following provide for a number of different and alternative possibilities for regulation of the finishing proportions of the moistening, coating and/or finishing drying of the opposite sides $W_a$ and $W_y$ of the web W. The type of finishing section D2 that is selected depends on the quality of the paper produced and on the different running parameters of the machine. As to the coating of the web W, it should be stated that the coating agents are materials inert in respect of the tendency of curling, so that they in themselves already contribute to a possibility of controlling and reducing the tendency of curling. Asymmetric web W coatings can also be used.

In some of the illustrated embodiments described above, a frame construction 100 of the paper machine has also been sketched. As shown in FIG. 1, underneath the finishing section D2, there is a broke conveyor 19,19*a*,19*b* which carries the broke likewise to the pulper 19*c*. In the finishing section D2, one group $R_{22}$ with twin-wire draw is also shown, which is provided with a lower wire 35B, so that this group is not open toward the bottom. In the area of the group $R_{22}$, owing to the group $R_{21}$ with single-wire draw, the web is already so dry that, in the area of this group $R_{22}$, there is no substantial risk of breaks, which breaks would lower the overall efficiency of the paper machine.

Figure 3:
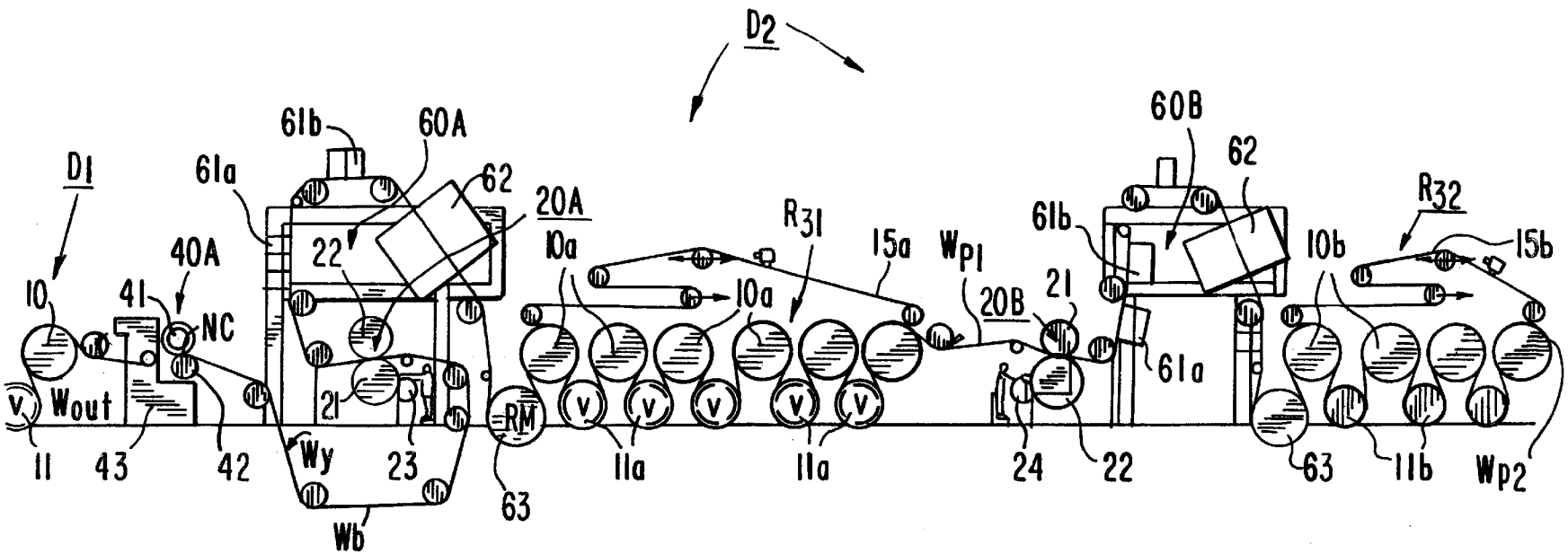
FIG. 3 shows a two-stage coating/surface-sizing unit placed after a finishing dryer.

FIG. 3 shows an exemplifying embodiment of a two-stage coating/surface-sizing unit which is provided with the current assignee's Sym-Sizer™ device. A paper web Wout is brought from the forward dryer section D1 wherein it is asymmetrically dried and thus having a tendency of curling. The paper web Wout is passed through a calender 40A having a calendering nip NC in which the paper web is worked so that the tendency of curling is reduced. The web may be worked asymmetrically in the calendering nip NC as described below and this calendering nip between the forward dryer section D1 and the finishing section D2 may be applied in any of the embodiments described herein as an alternative to the direct passage of the web from the forward dryer section D1 to the finishing section D2. If necessary or desired, as the calender 40A, it is also possible to use two or more soft calender units placed one after the other. After the calender 40A, the paper web $W_k$ is passed into a first coating station 60A which comprises a coating unit 20A defined by coater rolls 21 and 22. In connection with the lower roll 21, there is a coating-agent applicator device 23, so that an upper face $W_y$ of the web $W_k$ (oriented downward in the coating unit 20A, is coated with the coating agent while it may be, at the same time, moistened to a significant extent. The coating station 60A includes infrared dryers 61*a* and 61*b*, by whose means the moistened web face $W_y$ is primarily dried free of contact. After that, in the unit 60A, an air-impingement dryer unit 62 is arranged, in which the web $W_k$ is dried further free of contact primarily from the side of its moistened face $W_y$. Thereafter, the web $W_k$ is passed over a cylinder 63 to a first group R31 of finishing-drying cylinders. The face of the cylinder 63 is coated with some coating that prevents adhesion of the web, such as, for example, the current assignee's "Release Mate"™ coating. The group R31 is a group with single-wire draw in itself known, in which there are steam-heated drying cylinders 10*a* in an upper row and Vac suction cylinders 11*a* in a lower row as well as an upper drying wire 15*a*. On the cylinders 10*a*, the web $W_k$ is dried from the side of its lower face Wa, i.e. from the side opposite to that dried in the unit 60A and previously coated. In this manner, a symmetric drying is ensured.

The finishing unit D2 comprises a second coating station 20B which is arranged after the group $R_{31}$ with single-wire draw and which comprises a pair of coater rolls 21 and 22. Of these rolls, in connection with the lower roll 22, there is a coating-agent applicator device 24, so that the web $W_{p1}$, whose upper face has been coated, is also coated from the side of its lower face Wa, whereby the web may be, at the same time, again moistened. After this, a second drying unit 60B follows, which comprises infrared units 61*a* and 61*b* which dry the web from the side of the lower face Wa, and an air-impingement unit 62. The unit 60B is followed by a second short group $R_{32}$ with single-wire draw, in which there are drying cylinders 10*b* in an upper row and reversing suction cylinders 11*b* in a lower row and in which there is an upper drying wire 15*b*. From the group $R_{32}$, a web $W_{p2}$ is received which has been coated from both sides and dried in a purposeful manner in view of compensating for the tendency of curling of the web since the moistening of the web via the coating process reduces its internal stresses and thus also the tendencies of curling. Thereafter, the web $W_{p2}$ is passed to the machine reel-up 50 (FIG. 1).

Figure 4:
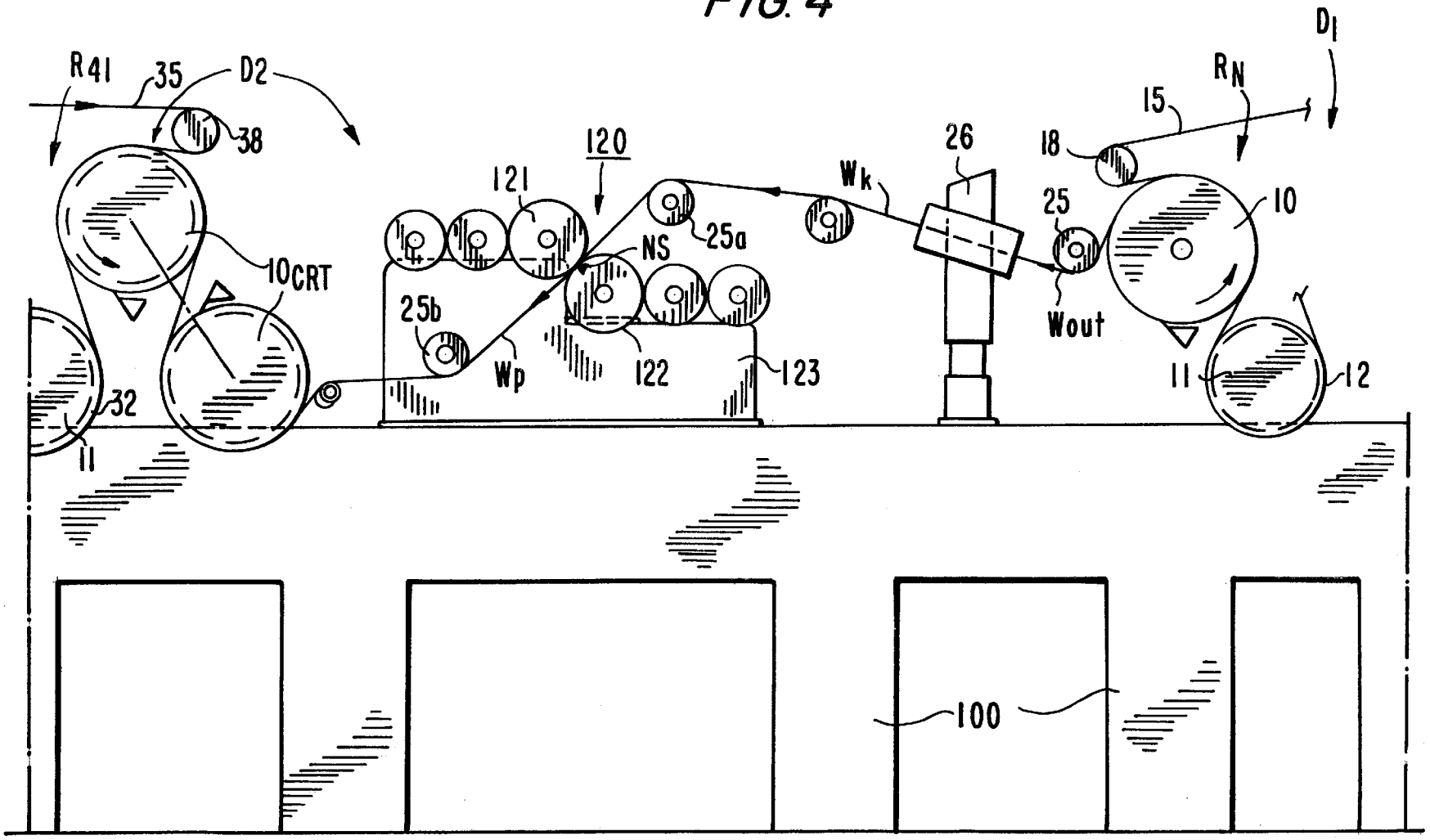
FIG. 4 shows a gate-roll surface-sizing unit as a finishing unit wherein, differing from the preceding and the following illustrated embodiments, the web proceeds from right to left.

FIG. 4 shows a gate-roll surface-sizing unit 120 as the first finishing unit after the last group $R_N$ with single-wire draw in the forward dryer section, to which unit 120 the web $W_k$ is passed over paper guide rolls 25 and 25*a* and across the measurement beam 26. In FIG. 4, it should be noted that, differing from the preceding and the following figures, the web arrives from the right. By means of a pair of rolls 121 and 122 in the gate-roll surface-sizing unit 120, the web $W_k$ is surface-sized, whereby it is moistened significantly from both sides. Thus, the tendencies of curling arising from the asymmetric drying in the forward dryer section D1 are prevented. The paper web $W_p$ that has been coated from both sides is passed over the paper guide roll 25*b* into the single-wire group $R_{41}$ in the finishing dryer section D2, in which group the first drying cylinders $\mathbf{10}_{CRT}$ have been coated, e.g., with chromium-TEFLON™ so as to prevent adhesion of the moist web $W_p$. After the single-wire group $R_{41}$, the finishing dryer and the other finishing devices can be similar to those illustrated in the preceding or following figures, being arranged in such a way that, in the finishing dryer section D2, the web is dried from the sides of both of its faces $W_a$ and $W_y$, so that the drying is sufficiently symmetric in the z-direction to compensate for any curling flaws that have already arisen in the paper and to prevent further formation of such curling faults.

Figure 5:
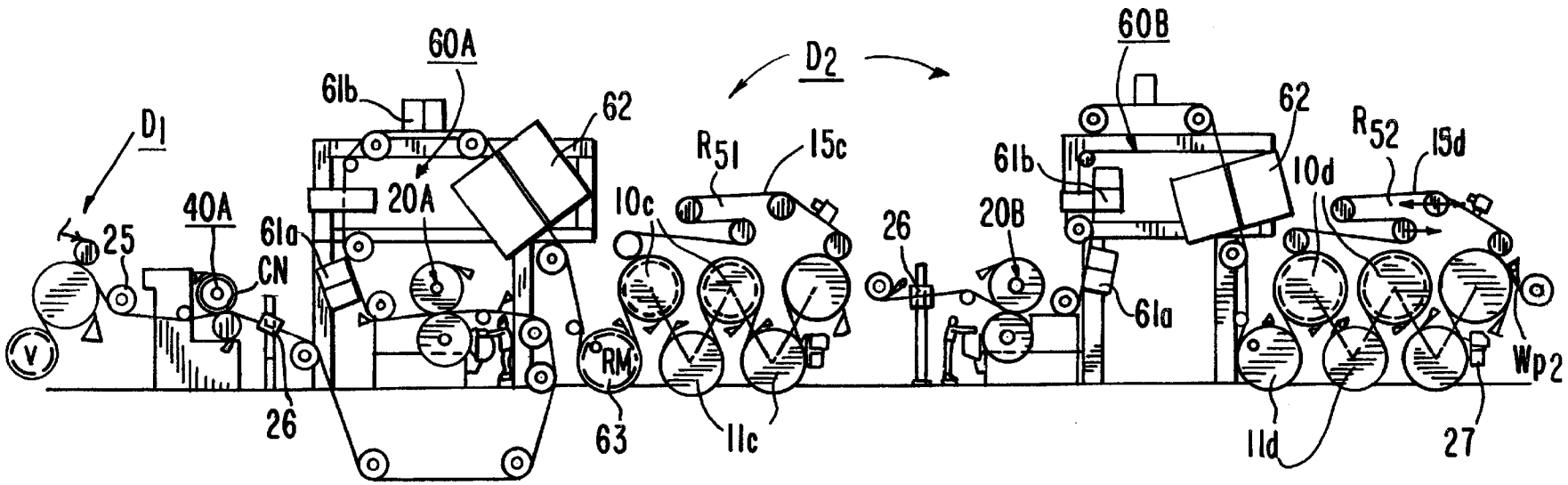
FIG. 5 shows a second exemplifying embodiment of a two-stage coating/surface-sizing unit and of its finishing dryer.

FIG. 5 shows an alternative embodiment of a two-stage coating/surface-sizing unit as shown in FIG. 3. The finishing section D2 shown in FIG. 5 is in other respects similar to that described above except that the group $R_{51}$ with single-wire draw arranged between the units 60A and 60B is considerably shorter than the corresponding group $R_{31}$ in FIG. 3. The group $R_{51}$ comprises two steam-heated cylinders 10*a* as upper cylinders, and the group comprises a "Release Mate"™ cylinder 63 as the first lower cylinder, as well as two reversing cylinders 11*c*. In the manner described above, the group $R_{51}$ is followed by the other coating station 20B and its dryer unit 60B. Then, there follows the second group $R_{52}$ with single-wire draw, which is similar to the group $R_{51}$ with single-wire draw and which has an upper drying wire 15*d*, upper drying cylinders 10*d*, and lower reversing cylinders 11*d*.

In the embodiment shown in FIG. 5, and also in some other preceding illustrated embodiments, a paper-tail cutting device 27 is shown by whose means the paper tail is cut from one edge of the web W, to be widened finally to a web of full width in a manner in itself known.

In the invention, it is advantageously possible to apply ropeless tail threading because of the forward dryer D1 that comprises groups $R_1, \ldots, R_N$ with single-wire draw and of the finishing section D2 that is arranged appropriately.

Figure 6:
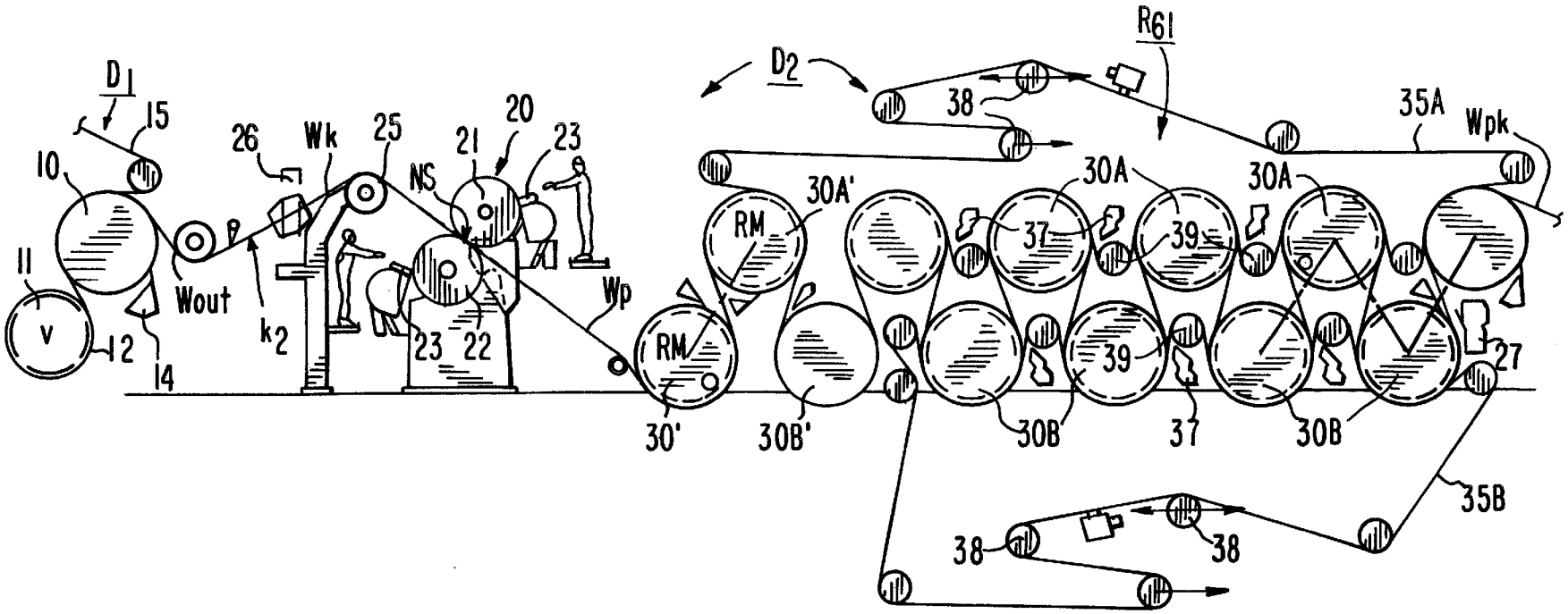
FIG. 6 shows a finishing unit that comprises a two-sided surface-sizing device and its finishing dryer.

FIG. 6 shows a finishing section D2 which includes a double-sided surface-sizing unit 20. This unit 20 is similar to that described above in relation to FIG. 2B. In the unit 20, the web $W_k$ is coated and moistened from both sides so that the web $W_p$ passing to the finishing dryer is moistened from both sides and the strains that produce a tendency of curling in the web are substantially relaxed. The finishing dryer shown in FIG. 6 differs from that shown in FIG. 2B in the respect that, in FIG. 6, there is just one finishing dryer group $R_{61}$ in whose initial part, a single-wire draw is applied by means of an upper wire 35A and drying cylinders 30A' and 30B'. In the final end of the group $R_{61}$, a twin-wire draw is applied in the manner described above by means of the wires 35A and 35B. With regard to the twin-wire draw, the arrangement of equipment and the performance of the drying are similar to those described above with regard to the group $R_{22}$ in FIG. 2C. In the beginning of the group $R_{61}$ as shown in FIG. 6, first, there is a lower drying cylinder 30' which has been coated in the manner described above, and after that there is a corresponding upper drying cylinder 30A', after which the draw of the upper wire 35A starts under the cylinder 30B'. This is followed by the twin-wire draw similar to that described above and accomplished by means of the upper and lower wires 35A and 35B. Thus, after the coating, a symmetrically dried web $W_{pk}$ is obtained which has no tendency of curling.

Figure 7:
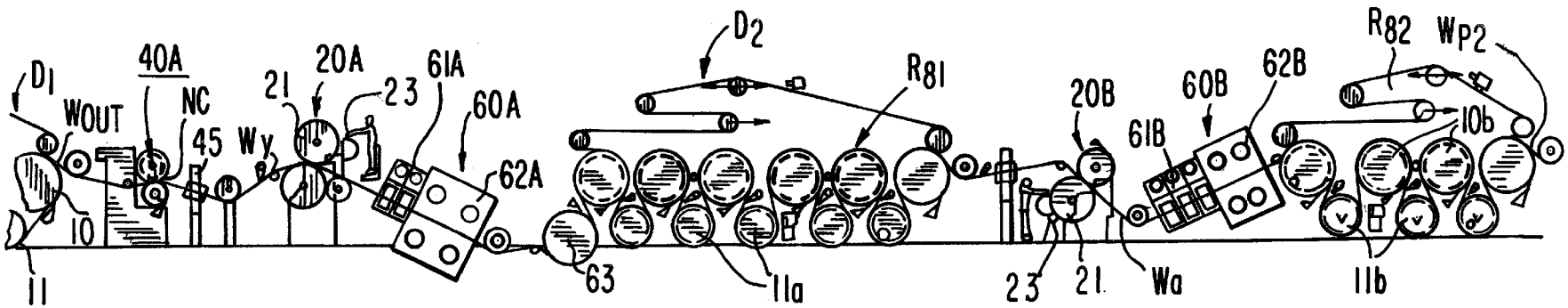
FIG. 7 shows a third exemplifying embodiment of a two-stage coating/surface-sizing unit between and after which there are groups with single-wire draw that constitute finishing dryers.

FIG. 7 shows a modification of the finishing section D2 as shown in FIG. 3 which is in other respects similar to that shown in FIG. 3 except that the drying units 60A and 60B placed after the coating units 20A and 20B have been accomplished in a different manner. As shown in FIG. 7, the web Wout is brought from the forward dryer section D1 in accordance with the invention and passed into the calender 40A through the calendering nip NC to the coating unit 20A, where the upper face $W_y$ of the web is coated, whereby it is moistened to a significant extent. Calender 40A may be a soft calender and/or constructed to asymmetrically calender the web as described below with reference to FIGS. 11 and 11A. If necessary or desired, as the calender 40A, it is also possible to use two or more soft calender units placed one after the other. After the coating unit 20A, the web is passed into a combination dryer 60A, which comprises initially an infrared unit 61A and thereupon an airborne unit 62A, in which the drying effect is concentrated on the moistened top side $W_y$ of the web. Thereafter, a group $R_{81}$ with single-wire draw is arranged which is similar to that shown in FIG. 3. In the group $R_{81}$, the web is dried on the drying cylinders 10*a* mainly from the side of its lower face Wa. After the group $R_{81}$, a second coating unit 20B is arranged in which the web is coated and moistened from the side of its lower face Wa. Thereafter, a second combination dryer 60B is arranged in which there is first an infrared unit 61B and then an airborne unit 62B in which the web drying effect is concentrated on the upper face $W_y$ of the web. This is followed by a further group $R_{82}$ with single-wire draw which is similar to that shown in FIG. 3. In this group $R_{82}$, the drying effect is concentrated on the lower face $W_a$ of the web. Thus, a web $W_{p2}$ is produced that has been coated from both sides and dried symmetrically and thus its tendency of curling has been reduced or at least partly prevented.

Relative portions of drying taking place in the infrared drying unit(s) 61A,61B, in the air-impingement dryer or airborne unit(s) 62A,62B and in cylinder sections associated therewith $R_{81}$ and $R_{82}$ can be varied as required or desired to provide optimum conditions.

Figure 8:
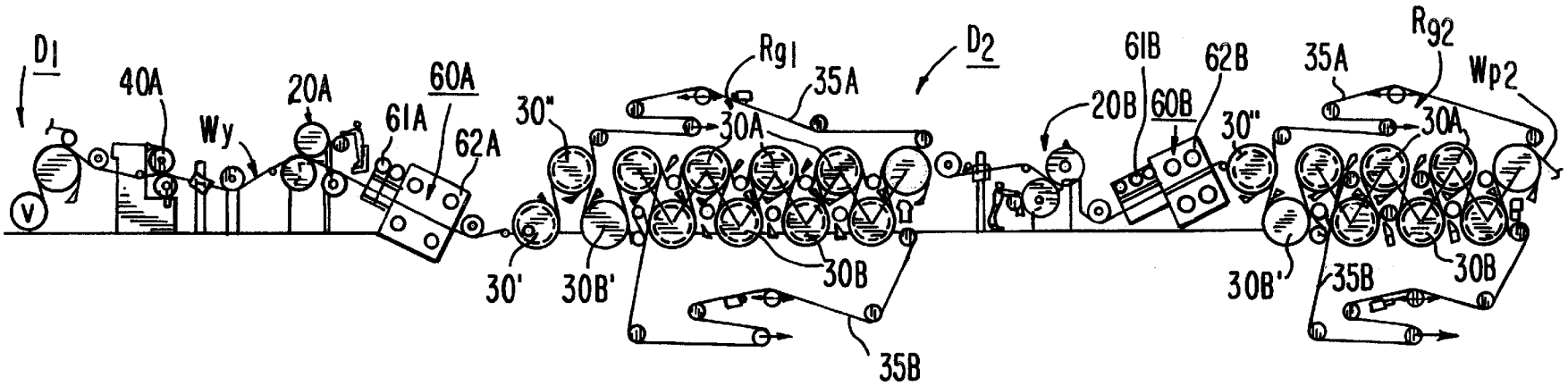
FIG. 8 shows another exemplifying embodiment of a two-stage coating/surface-sizing unit such as that shown in FIG. 7 between and after which there are groups with single-wire draw that constitute finishing dryers, which are two groups with twin-wire zones.

FIG. 8 illustrates double-sided coating as shown in FIG. 7 in the finishing unit D2, which is in other respects similar to that shown in FIG. 7, except that the finishing-drying groups $R_{91}$ and $R_{92}$ of FIG. 8 differ from the corresponding groups R81 and R82 shown in FIG. 7. The first group $R_{91}$ shown in FIG. 8, placed after the first combination dryer 60A, is similar to the group $R_{61}$ shown in FIG. 6, so that in its initial end there are two coated drying cylinders 30' and 30". After drying cylinders 30' and 30", a lower reversing cylinder 30B' is arranged, after which the twin-wire draw starts, which is accomplished by means of the upper and lower wires 35A and 35B and in which the web is dried from the sides of both of its faces $W_y$ and Wa. After the group $R_{91}$, a second coating unit 20B is arranged which is similar to that described in FIG. 7 and in which the web is coated and moistened from the side of its lower face Wa. Thereafter, a combination dryer 60B similar to that described above is arranged. The last group $R_{92}$ is in other respects similar to the group $R_{91}$ described above, the only difference being that the lower cylinder 30' is missing and that the group $R_{92}$ has one pair fewer heated drying cylinders 30A. From the finishing section D2 as shown in FIG. 8, a web $W_{p2}$ is obtained that has been coated double-sidedly and that has been dried so that it has no tendency of curling.

Figure 9:
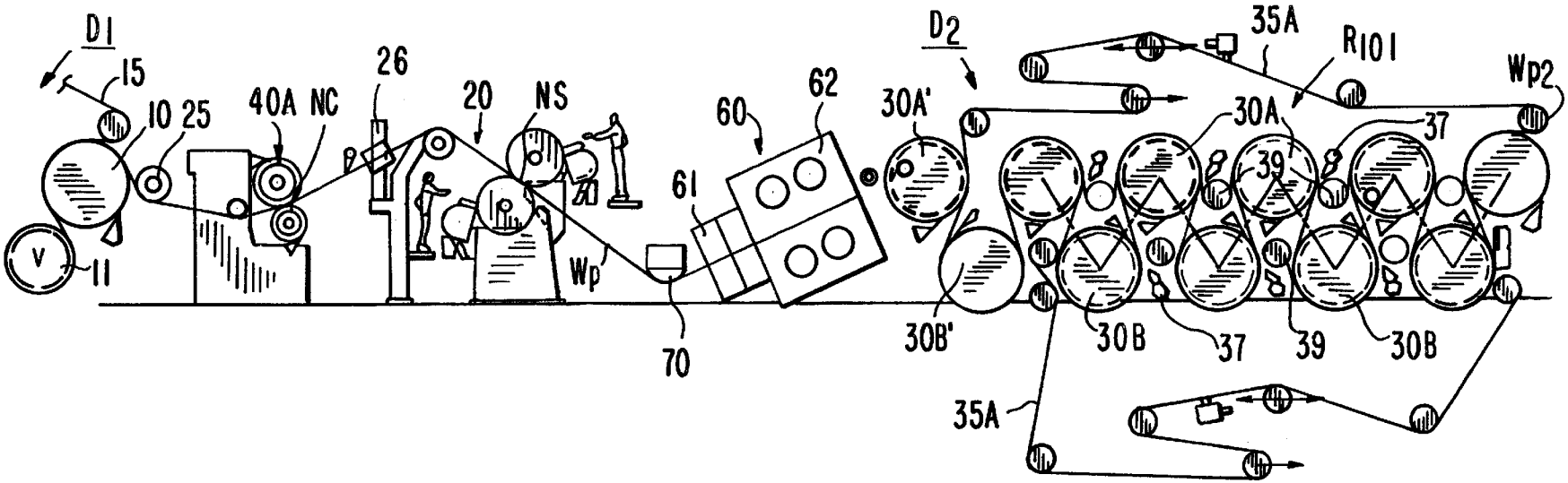
FIG. 9 shows a third exemplifying embodiment of a two-sided surface-sizing unit, of a subsequent turning air-impingement unit, and a finishing dryer.

FIG. 9 shows a modification of a finishing section D2 which essentially resembles that shown in FIG. 6 and which is in other respects similar to FIG. 6 except that the web $W_p$ that has been coated double-sidedly in the coating unit 20 is passed after the coating nip NS as a downward inclined run to a reversing airborne unit or turning airborne unit 70. By means of the contact-free guidance provided by the reversing airborne unit 70, the run of the web is turned from having been downwardly inclined, through about 50° to about 70°, to become upwardly inclined. The unit 70 performs the turning of the moist web free of contact and, to some extent, also applies a drying effect to the upper face of the web.

After the unit 70, the web W is passed in the upwardly inclined straight run through the combination dryer 60, in which there is first an infrared unit 61 and after that a contact-free airborne unit 62. After the combination dryer 60, the web $W_p$ is passed to the twin-wire unit $R_{101}$, in whose initial end there is a short portion with single-wire draw, which comprises a coated upper cylinder 30A' and a non-coated reversing cylinder 30B'. After the initial end, the body of group $R_{101}$ with twin-wire draw is arranged, which is similar to that described above and which has been accomplished by means of the upper and lower wires 35A and 35B and by means of the drying cylinders 30A and 30B. From the group $R_{101}$, a web $W_{p2}$ is obtained which has been coated double-sidedly and which has no detrimental tendency of curling, in spite of the asymmetric drying that was carried out in the forward dryer section D1.

Figure 10:
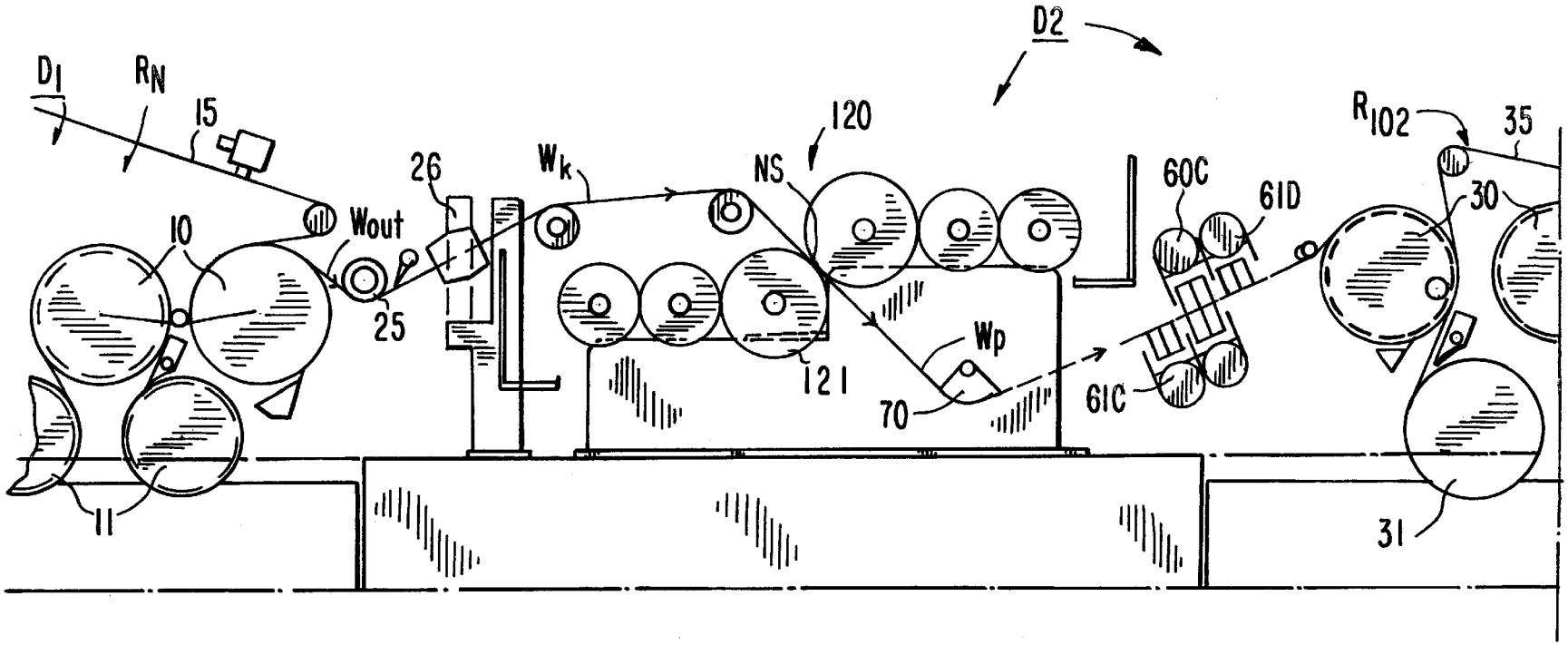
FIG. 10 shows a gate-roll surface-sizing unit as a finishing unit which is similar to FIG. 4, however in this embodiment after the gate-roll, there is a provision made for an infrared dryer unit, and the transfer into the cylinder group in the finishing dryer which is not shown in FIG. 4.

FIG. 10 shows such a modification of the finishing section D2 as shown in FIG. 4 in which the web Wout is passed over the paper guide roll 25 and through a measurement beam 26 to a gate-roll coating unit 120 similar to that shown in FIG. 4, in whose coating nip NS the web $W_k$ is moistened and coated from both sides. The transfer of the coated web $W_p$ after the gate-roll unit 120, as shown in FIG. 10, differs from FIG. 4 in the respect that the web $W_p$ is passed through a reversing airborne unit 70 (also referred to as a turning airborne unit), which turns and carries the web free of contact and in which the downwardly inclined run of the web is turned through about 60° to become an upwardly inclined run. On the upwardly inclined run of the web, an infrared dryer unit 60C is arranged to operate, in which a lower unit 61C dries the web from the side of its lower face $W_a$ and a upper unit 61D dries the web from the side of its upper face $W_y$. After this, the web is passed to the group $R_{102}$ with single-wire draw, which is similar to that described above.

Figure 11A:
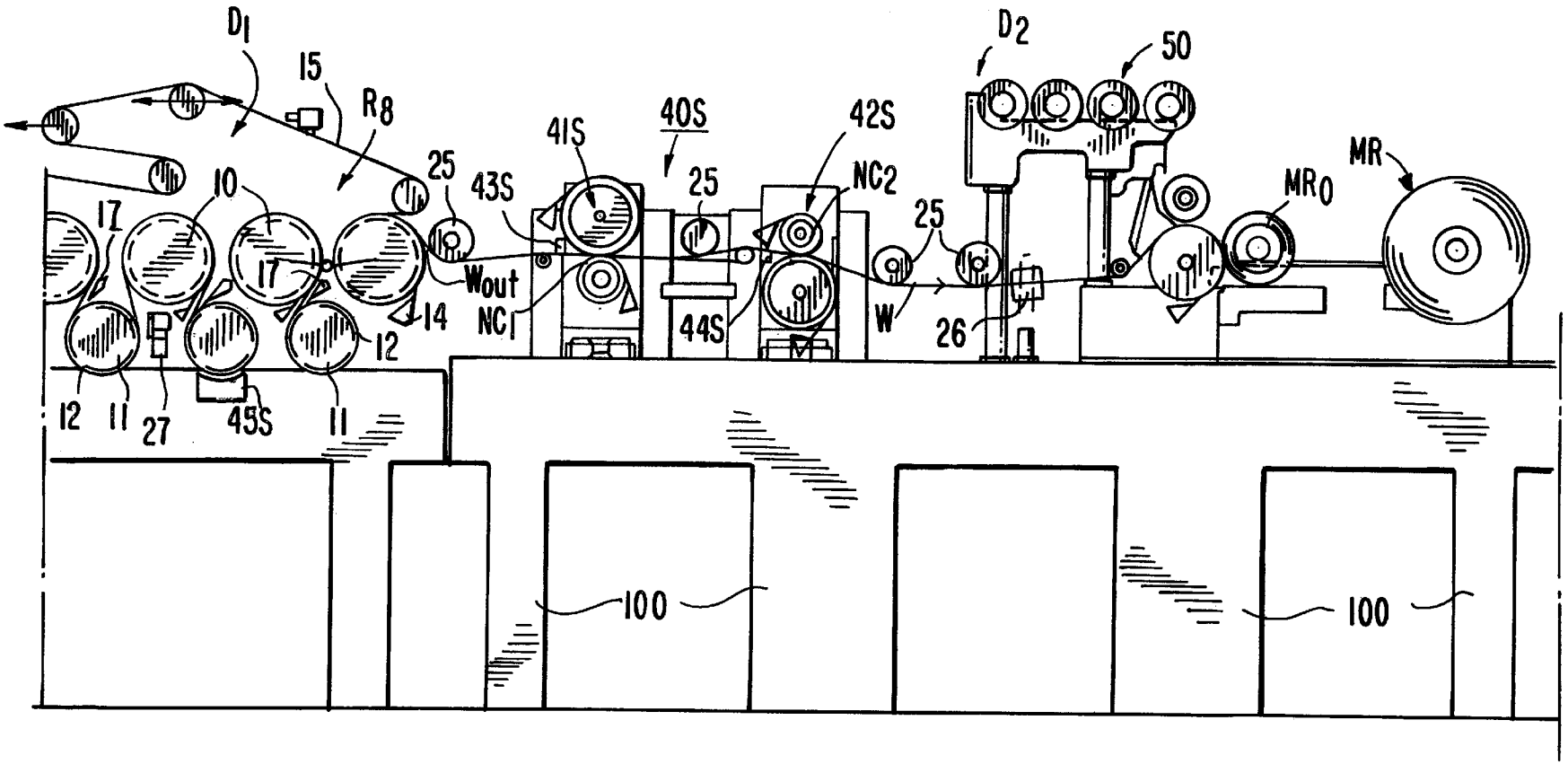
FIG. 11A shows the rear end of FIG. 11 on an enlarged scale.

FIGS. 11 and 11A are illustrations similar to FIG. 1 of a combination of a forward dryer section D1 and a finishing section D2 in accordance with the invention in which the finishing section comprises a soft calender 40S alone. If necessary, as the calender, it is also possible to use two or more soft calender units placed one after the other. In a soft calender, one of the rolls is generally heated while the other roll has a softer coating which thereby provides friction to the web. As shown in FIG. 11A, the soft calender 40S comprises two soft-calender units 41S and 42S placed one after the other. In the calendaring nips $NC_1$ and $NC_2$ in the soft calender 40S, the web is worked by the effects of heat and compression pressure and, if necessary, friction, so that the drying strains that arose in the forward dryer section D1 because of the asymmetric drying of the web and the resulting tendencies of curling are relaxed during the working to an extent sufficient in view of the purpose of use of the calendared uncoated paper. More specifically, the web may be asymmetrically calendered in each calendering nip by applying an asymmetric loading of the rolls, asymmetrically moistening the web before the calendering nip so as to affect the calendering in the nip, providing the rolls with a different temperature and/or providing the rolls with a different hardness.

Furthermore, as shown in FIGS. 11 and 11A, underneath the reversing cylinders 11 in the last wire group $R_8$, moistening means such as a steam box 45S are arranged, in whose treatment gap the web that is placed at the side of the outside curve can be steam-treated and, thus, strains that cause curling can be relaxed. Also, moistening means such as a steam box 43S are arranged before the first calendaring nip $NC_1$ by whose means the upper face of the web W can be steam-treated. Similarly, a lower steam box 44S is arranged before the second calendaring nip $NC_2$ by whose means the lower face of the web can be steam-treated. By means of the steam-treatment, the tendency of curling can be reduced. For example, by applying different quantities of steam from steam boxes 43S,44S to the respective side of the web before the respective calendering nip to thereby provide asymmetric moistening of the web.

After the calender 40S or corresponding calenders, the web is passed to the machine reel-up 50. The reel that is being formed in the reel-up is denoted by reference $MR_c$, and the complete machine reel is denoted by reference MR.

In FIGS. 3–11, a number of different variations have been illustrated by whose means the relative proportions of the moistening and/or plastic working of the different sides of the web W to be coated/calendared can be set and controlled in order to eliminate and/or to compensate for the tendency of curling of the web W that has arisen in the forward dryer section D1. Generally, the coating materials are materials that are inert in themselves in respect of the tendency of curling, so that they as such reduce the tendency of curling remaining in the base paper.

Figure 12:
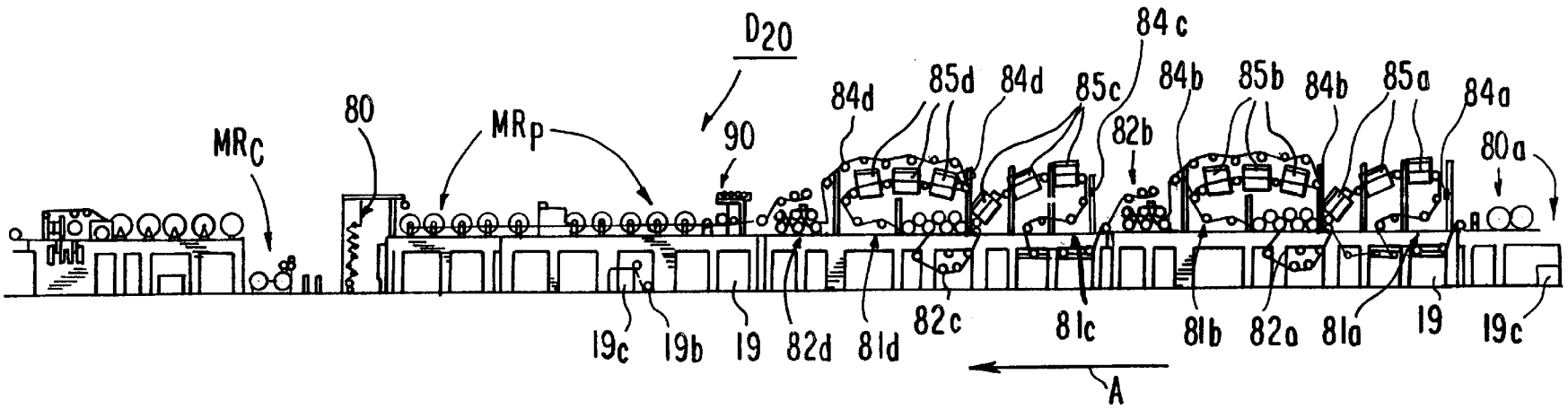
FIG. 12 shows an exemplifying embodiment of an off-line coating unit, which is applied after a forward dryer section in which there are no inverted groups, so that an overall combination that makes use of the method of the present invention is obtained. In this figure, the process sequence is from right to left.

In FIG. 12, as a finishing section D20, such an off-line coating unit is shown as can be used in connection with a forward dryer section D1, in which, in accordance with the invention, the web has been dried from the side of its lower face $W_a$ only asymmetrically in the groups $R_1, \ldots, R_N$ with single-wire draw. The web coming from such a forward dryer section D1 can be passed through a calender 40 or even without calendaring to the machine reel-up 50. The machine reels MR obtained from the reel-up, whose paper has a tendency of curling because of the asymmetric drying described above, are passed in a subsequent off-line treatment stage to the finishing section D20 as shown in FIG. 12.

With regard to the embodiment shown in FIG. 12, it should be noted that the process proceeds in the direction of the arrow A from right to left. After the unwind stand 80*a*, the paper web is passed to the coating unit 81*a* which is followed by an infrared dryer unit 84*a* and, after that, by three successive airborne dryer units 85*a*. Thereafter, the web is passed through a cylinder dryer unit 82*a* to the next coating unit 81*b*, in which the opposite side of the web is coated. This is followed by an infrared dryer unit 84*b*, and after that by three successive airborne dryer units 85*b*, after which the web is passed to the second cylinder dryer unit 82*b*. When the process makes progress, there follows a third coating unit 81*c* and, after it, an infrared dryer unit 84*c*, which is followed by three successive airborne dryer units 85*c* and a third drying-cylinder unit 82*c*. After the last-mentioned unit, in the process, there is a fourth coating unit 81*d*, which is followed by an infrared unit 84*d* and by three successive airborne dryer units 85*d*. After airborne dryers 85*d*, an infrared unit 84*d* and a fourth drying-cylinder unit 82*d* are arranged. Thereafter, the web is passed to the reel-up 90 from which the coated reels $MR_p$ are transferred to the unwind stand of the supercalender 80. The reels $MR_p$ are calendared in the supercalender 80, and from the outlet side of the supercalender 80 the supercalendered reels $MR_c$ are obtained.

Figure 13:
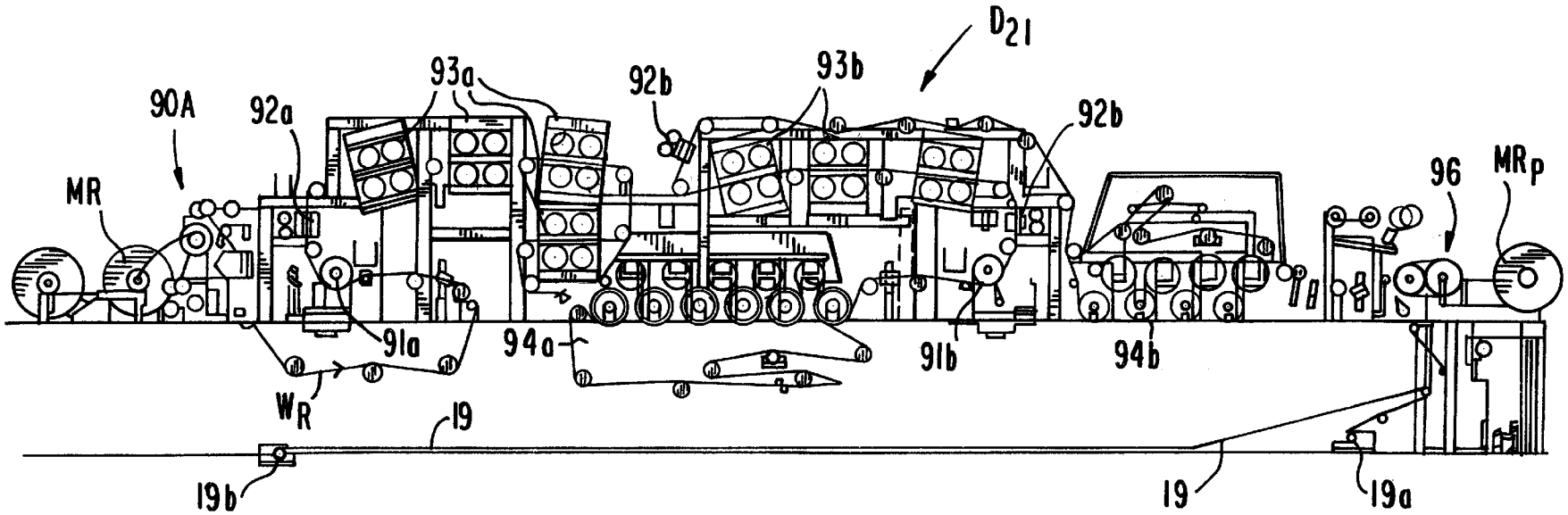
FIG. 13 shows a second exemplifying embodiment of an off-line coating unit applied in the method of the invention and of its finishing dryer.

FIG. 13 shows an alternative embodiment of a finishing section D21, which comprises an off-line coating unit and its dryer section. The paper reels MR which have been dried and reeled by means of the forward dryer section D1 described above and whose paper has a tendency of curling are unwound by means of the unwind stand 90*a* and then passed into the coating unit 91A, in which one side of the web is coated, whereby it becomes moistened at the same time.

After coating unit 91A, the first infrared dryer unit 92*a* is arranged after which the web is passed through three successive airborne dryer units 93*a* to the first cylinder dryer 94*a*, which is an inverted cylinder group provided with single-wire draw. After the inverted cylinder group provided with single-wire draw, there follows the coating unit 91*b* for the opposite side of the web, in which unit the opposite side of the web is moistened. After this, the web that has been moistened and that has been coated from both sides is passed to the first infrared dryer unit 92*b*, after which there are three successive airborne dryer units 93*b* and a second infrared dryer unit 92*d*. After the second infrared dryer unit 92*d*, the web is passed to the second cylinder dryer unit 94*b*, which is a group of drying cylinders provided with single-wire draw, in which the contact-drying cylinders are situated in the upper row and the reversing suction cylinders are situated in the lower row. After this, the web that has been coated and dried from both sides is passed to the reel-up 96, from which machine reels $MR_p$ are obtained whose paper has been dried and coated from both sides and has no tendency of curling. The machine reels $MR_p$ thus produced are passed to a supercalender 80 similar to that shown in FIG. 12. Thus, in spite of the asymmetric drying that took place in the forward dryer section D1, it is possible to produce paper that has no detrimental tendency of curling.

The examples provided above are not meant to be exclusive. Many other variations of the present invention would be obvious to those skilled in the art, and are contemplated to be within the scope of the appended claims.

We claim:

1. A method for producing surface-treated paper from a paper web which has been dewatered by pressing to substantially a first dry solids content of from about 35% to about 60%, comprising the steps of:

drying the web in a forward dryer section by passing the web through only a plurality of successively arranged drying groups with single-wire draw that are open downward, each of said drying groups having steam-heated drying cylinders arranged in a first row and reversing suction cylinders arranged in a second row below said first row, the side of the web being dried being passed into direct contact with a face of said drying cylinders, passing the web from the forward dryer section to a finishing section, passing the web through at least one surface-sizer or coating device arranged in the finishing section, applying size from said at least one surface-sizer or a coating agent from said at least one coating device onto one or both sides of the web to treat the surface of the web, drying the web in an after-dryer section after the web has passed through said at least one surface-sizer or coating device, and reducing a curling tendency of the web that arises in the forward dryer section by passing the web through at least one calendering nip, each defined by a pair of rolls, and asymmetrically calendering the web in the at least one calendering nip to thereby affect the sides of the web to different degrees.

2. The method of claim 1, wherein the web is passed from the forward dryer section to the finishing section without the interposition of an additional drying group.

3. The method of claim 1, wherein the step of asymmetrically calendering the web in the at least one calendering nip comprises the step of applying an asymmetric loading of the rolls in the at least one calendaring nip to thereby subject each side of the web to a different working effect.

4. The method of claim 1, wherein the web is passed from the forward dryer section through the at least one calendering to the finishing section.

5. The method of claim 1, further comprising the steps of:

passing the web from the after-dryer section to the at least one calendering nip, and passing the web from the at least one calendering nip to a machine reel-up.

6. The method of claim 1, wherein the step of asymmetrically calendering the web in the at least one calendering nip comprises the step of providing the rolls in the at least one calendering nip with a different temperature to thereby subject each side of the web to a different working effect.

7. The method of claim 1, wherein the step of asymmetrically calendering the web in the at least one calendering nip comprises the step of providing the rolls in the at least one calendering nip with a different hardness to thereby subject each side of the web to a different working effect.

8. The method of claim 1, wherein the step of reducing the curling tendency of the web further comprises the step of moistening one side of the web at a location before the at least one calendering nip.

9. The method of claim 8, wherein the step of moistening the web comprises the steps of:

arranging a steam box before the at least one calendering nip, and directing steam from the steam box onto that one side of the web.

10. The method of claim 1, wherein the step of asymmetrically calendering the web in the at least one calendering nip comprises the step of applying different quantities of moistening agent to both sides of the web before the at least one calendering nip to thereby asymmetrically moisten the web.

11. The method of claim 1, wherein the at least one calendering nip comprises a plurality of calendering nips.

12. The method of claim 1, wherein the step of asymmetrically calendering the web in the at least one calendering nip comprises a combination of at least two of the following steps:

applying different quantities of moistening agent to both sides of the web before the at least one calendering nip to thereby asymmetrically moisten the web, providing the rolls in the at least one calendering nip with a different temperature, and providing the rolls in the at least one calendering nip with a different hardness.

* * * * *